US008831483B2

(12) United States Patent
Mihara et al.

(10) Patent No.: US 8,831,483 B2
(45) Date of Patent: Sep. 9, 2014

(54) DEVELOPING DEVICE AND IMAGE FORMING APPARATUS

(75) Inventors: Koichi Mihara, Osaka (JP); Takafumi Nagai, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 328 days.

(21) Appl. No.: 13/403,068

(22) Filed: Feb. 23, 2012

(65) Prior Publication Data

US 2012/0219327 A1 Aug. 30, 2012

(30) Foreign Application Priority Data

Feb. 25, 2011 (JP) ..... P2011-40970

(51) Int. Cl.
*G03G 15/06* (2006.01)
*G03G 15/08* (2006.01)

(52) U.S. Cl.
CPC .... *G03G 15/0893* (2013.01); *G03G 2215/0822* (2013.01); *G03G 2215/0132* (2013.01); *G03G 2215/0838* (2013.01)
USPC ..... 399/254; 399/119

(58) Field of Classification Search
CPC ..... G02G 15/0889; G02G 15/0891; G02G 15/0893; G02G 15/0896; G02G 15/0822
USPC ..... 399/119, 252–256
See application file for complete search history.

(56) References Cited

U.S. PATENT DOCUMENTS

| | | | | |
|---|---|---|---|---|
| 8,588,657 | B2 | 11/2013 | Hayashi et al. | |
| 2004/0179865 | A1 | 9/2004 | Nishiyama | |
| 2005/0031381 | A1 | 2/2005 | Arimoto | |
| 2006/0140679 | A1 | 6/2006 | Iwata et al. | |
| 2010/0196058 | A1* | 8/2010 | Mihara et al. | 399/256 |
| 2012/0051794 | A1* | 3/2012 | Hayashi et al. | 399/254 |

FOREIGN PATENT DOCUMENTS

| | | |
|---|---|---|
| JP | 07-244425 | 9/1995 |
| JP | 2004-045945 | 2/2004 |
| JP | 2004-272017 | 9/2004 |
| JP | 2005-55531 | 3/2005 |
| JP | 2006-162810 | 6/2006 |
| JP | 2006-163292 | 6/2006 |
| JP | 2009-258446 | 11/2009 |
| JP | 2010-002703 | 1/2010 |

OTHER PUBLICATIONS

Notice of Allowance issued in U.S. Appl. No. 13/213,548 dated Sep. 9, 2013.

* cited by examiner

*Primary Examiner* — Walter L Lindsay, Jr.
*Assistant Examiner* — Jessica L Eley
(74) *Attorney, Agent, or Firm* — Nixon & Vanderhye P.C.

(57) ABSTRACT

In a developing device including a developer tank and a developing roller, an internal space of the developer tank is divided into a first conveying path, a second conveying path, a first communication path and a second communication path, by a partition wall. A first developer conveying section which conveys a developer in the developer tank in a conveying direction X is disposed in the first conveying path. A second developer conveying section which conveys the developer in the developer tank in a conveying direction Y is disposed in the second conveying path. The first developer conveying section includes a plurality of inner spiral blade pieces, a rotation tube, an upstream spiral blade, a downstream spiral blade, support members, and a first gear.

5 Claims, 15 Drawing Sheets

DEVELOPING DEVICE AND IMAGE FORMING APPARATUS

CROSS-REFERENCE TO RELATED APPLICATION

This application claims priority to Japanese Patent Application No. 2011-40970, which was filed on Feb. 25, 2011, the contents of which are incorporated herein by reference in its entirety.

BACKGROUND OF THE TECHNOLOGY

1. Field of the Technology

The present technology relates to a developing device and an image forming apparatus.

2. Description or the Related Art

Copiers, printers, facsimiles, or the like include an image forming apparatus that forms an image by electrophotography. The electrophotographic image forming apparatus forms an electrostatic latent image on a surface of an image bearing member (photoreceptor) using a charging device and an exposure device, develops the electrostatic latent image by supplying developer using a developing device, transfers the developer image on the photoreceptor to a recording medium such as recording paper using a transfer section, and fixes the developer image onto the recording paper using a fixing device and thereby forms an image.

A toner supplied to the photoreceptor by the developing device is contained in a developer tank provided in the developing device. The developer contained in the developer tank is conveyed to a developing roller provided in the developing device. The developing roller rotates while bearing the developer on a surface thereof, and supplies the developer to the photoreceptor. The developer containing the toner is frictionally charged while being conveyed to the developing roller, and the charged developer is moved from the developing roller to the photoreceptor by electrostatic force between the surface of the photoreceptor and the electrostatic latent image. In this manner, the developing device develops the electrostatic latent image on the surface of the photoreceptor, and forms the developer image.

In recent years, accompanying the increase in speed and miniaturization of the image forming apparatus, a developing device capable of quickly and sufficiently performing the charging of the developer has been demanded. For example, Japanese Unexamined Patent Publication JP-A 2004-272017 discloses a circulation-type developing device including a developer conveying section that has a first conveying path, a second conveying path, a first communication path, and a second communication path which are formed by a partition wall provided inside a developer tank, and that conveys the developer in the first conveying path and the second conveying path in directions opposite to each other. The developer conveying section disclosed in JP-A 2004-272017 has a configuration where, to an auger screw type rotation shaft member having a rotation shaft member and a spiral blade spirally wound around the rotation shaft member, a flat plate-like member (fin) parallel with an axial line of the rotation shaft member is provided.

In the developer conveying section described in JP-A 2004-272017, a developer is conveyed in an axial direction of the rotation shaft member by the spiral blade, and the developer is also moved in a direction circumferentially of the rotation shaft member by the main surface of the fin while being electrically charged by friction. However, the negative aspect of the developer conveying section is that the developer is compressed when sandwiched between the spiral blade and the side surface of the fin, and the developer in a compressed state cannot be frictionally charged to a sufficient degree. If such an insufficiently charged developer is used, the image forming apparatus will fail to produce high-quality images.

Further, since the developer conveying section described in JP-A 2004-272017 conveys the developer by a single continuous spiral blade, when a new toner is supplied to the developer tank, the movement of the new toner is obstructed by the spiral blade. As a result, it is difficult for the new toner to diffuse in the axial direction of the rotation shaft member, and unevenness occurs in the concentration of the toner inside the developer tank, which causes image density unevenness in the image formed using the developing device.

SUMMARY OF THE TECHNOLOGY

The technology has been devised to solve the problem as mentioned supra, and an object of the technology is to provide a developing device and an image forming apparatus, capable of sufficiently charging developer and suppressing image density unevenness.

The technology provides a developing device for developing an electrostatic latent image formed on an image bearing member by supplying a stored developer to the image bearing member, including:

a developer tank that stores a developer;

a partition wall that divides an internal space of the developer tank into a first conveying path extending along a longitudinal direction of the partition wall, a second conveying path located toward the image bearing member, which is opposed to the first conveying path, with the partition wall, a first communication path for providing communication between the first conveying path and the second conveying path at a side of one longitudinal end of the partition wall, and a second communication path for providing communication between the first conveying path and the second conveying path at a side of another longitudinal end of the partition wall;

a first developer conveying section that is disposed in the first conveying path and conveys a developer in the developer tank from the side of the another longitudinal end to the side of the one longitudinal end, the first developer conveying section including a plurality of inner spiral blade pieces which have a shape which is wound around a side surface of an imaginary circular column and conveys the developer toward the side of the one longitudinal end from the side of the another longitudinal end by rotation around an axial line of the imaginary circular column, the plurality of inner spiral blade pieces being disposed so as to be spaced from each other, and a rotation tube which surrounds an outer circumferential portion of the plurality of inner spiral blade pieces, and rotates with the plurality of inner spiral blade pieces, the rotation tube having an admission port portion which is formed with a hole for admitting the developer into the rotation tube and is disposed on the side of the another longitudinal end of the partition wall, and a discharge port portion which is formed with a hole for discharging the developer from an inside of the rotation tube and is disposed on the side of the one longitudinal end of the partition wall; and a second developer conveying section which is disposed in the second conveying path and conveys a developer in the developer tank from the side of the one longitudinal end to the side of the another longitudinal end.

The developer in the first conveying path in the developer tank flows into the rotation tube through the admission port portion of the rotation tube on the side of the another longitudinal end. Further, the developer is conveyed toward the side of the one longitudinal end by the plurality of inner spiral blade pieces inside the rotation tube and flows outside the rotation tube through the discharge port portion of the rotation tube. At this time, the rotation tube rotates with the plurality of inner spiral blade pieces, and thus, friction arises between the developer conveyed by the plurality of inner spiral blade pieces and an inner wall of the rotation tube by the rotation. As a result, the developer is charged.

Thus, according to the developing device with this configuration, it is possible to suppress the developer from being compressed, and to sufficiently charge the developer to be conveyed in the first conveying path. Further, according to the developing device with this configuration, it is possible to rapidly and sufficiently charge even a new toner which has just been supplied to the developer tank. Further, according to the developing device with this configuration, since the developer is conveyed by the plurality of inner spiral blade pieces which are disposed so as to be spaced from each other rather than a single continuous spiral blade, when a new toner is supplied to the developer tank, it is possible to suppress the obstruction of movement of the new toner by the plurality of inner spiral blade pieces, and to efficiently diffuse the new toner into the developer as the developer is conveyed.

Further, it is preferable that the plurality of inner spiral blade pieces have a same shape and are disposed so as to be spaced from each other at regular intervals.

According to this configuration, the plurality of inner spiral blade pieces have a same shape and are disposed so as to be spaced from each other at regular intervals. Thus, the movement speed of the developer conveyed by the plurality of inner spiral blade pieces becomes uniform in the rotation tube, and thus, it is possible to further suppress compression of the developer.

Further, it is preferable that the first developer conveying section includes an upstream spiral blade which guides the developer existing outside the rotation tube to the admission port portion, is disposed on the side of the another longitudinal end with reference to the plurality of inner spiral blade pieces, and has a shape which has a constant internal diameter and an external diameter which becomes small continuously as it advances on the side of the another longitudinal end, the rotation tube is disposed to be inclined so that the side of the one end in the longitudinal direction thereof is disposed vertically above the side of the another end in the longitudinal direction thereof, and the developer tank includes a first conveying path-downstream region bottom part which faces a portion on the side of the one end in the longitudinal direction of the first conveying path and is disposed vertically below the portion on the side of the one end in the longitudinal direction of the rotation tube.

According to this configuration, the first developer conveying section includes an upstream spiral blade which is disposed on the side of the another longitudinal end with reference to the plurality of inner spiral blade pieces, and has a shape which has a constant internal diameter and an external diameter which becomes small continuously as it advances on the side of the another longitudinal end (that is, the shape having the external diameter which becomes large continuously as it advances on the side of the one longitudinal end). Thus, the amount of the developer conveyed toward the side of the one longitudinal end by the upstream spiral blade gradually increases as it advances on the side of the one longitudinal end. Thus, it is possible to slow down the conveyance speed of the developer conveyed by the entire upstream spiral blade while increasing the conveyance amount of the developer around the admission port portion of the rotation tube. As a result, it is possible to reliably guide the developer to the inside of the rotation tube.

Further, in the developing device with this configuration, the rotation tube is disposed to be inclined so that the side of the one end in the longitudinal direction thereof is disposed vertically above the side of the another end in the longitudinal direction thereof, and the first conveying path-downstream region bottom part of the developer tank is disposed vertically below the portion on the side of the one end in the longitudinal direction of the rotation tube. Thus, the developer which is guided to the inside of the rotation tube by the upstream spiral blade and is conveyed by the plurality of inner spiral blade pieces drops onto the first conveying path-downstream region bottom part when flowing out of the discharge port portion. As a result, it is possible to suppress the developer from being retained on the side of the one end in the longitudinal direction of the first conveying path due to the impact of the dropping, thereby making it possible to smoothly convey the developer.

Further, it is preferable that the developer tank includes a barrier part which is adjacent to the first conveying path-downstream region bottom part on the side of the another longitudinal end with reference to the first conveying path-downstream region bottom part and is protruded vertically above the first conveying path-downstream region bottom part.

According to this configuration, a barrier part is formed which is adjacent to the first conveying path-downstream region bottom part on the side of the another longitudinal end with reference to the first conveying path-downstream region bottom part and is protruded vertically above the first conveying path-downstream region bottom part. Thus, according to the developing device with this configuration, it is possible to suppress the developer from entering between the first developer conveying section and the inner wall of the developer tank from the side of the one longitudinal end.

Further, it is preferable that the developer tank includes a first conveying path-upstream region bottom part which faces a portion on the side of the another end in the longitudinal direction of the first conveying path and extends so as to be inclined such that a portion on the side of the another end in the longitudinal direction thereof is disposed vertically above a portion on the side of the one end in the longitudinal direction thereof.

According to this configuration, a first conveying path-upstream region bottom part is formed to be inclined so that the portion on the side of the another end in the longitudinal direction thereof is disposed vertically above the portion on the side of the one end in the longitudinal direction thereof. Thus, the developer on the first conveying path-upstream region bottom part moves to the side of the one longitudinal end due to its own weight. Thus, according to the developing device with this configuration, it is possible to smoothly convey the developer on the side of the another end in the longitudinal direction of the first conveying path to the admission port portion of the rotation tube, and as a result, to suppress stress generated in the developer.

Further, it is preferable that the first developer conveying section includes columnar support members which are disposed at opposite ends in the longitudinal direction thereof.

According to this configuration, the first developer conveying section includes support members which are respectively disposed at the opposite ends in the longitudinal direction thereof. Thus, it is possible to drive the first developer conveying section through the support members, thereby making it possible to simplify a drive mechanism of the developing device.

Further, it is preferable that the first developer conveying section includes a downstream spiral blade which guides the developer existing outside the rotation tube to the first communication path and is disposed on the side of the one longitudinal end with reference to the plurality of inner spiral blade pieces.

According to this configuration, the first developer conveying section includes a downstream spiral blade on the side of the one longitudinal end with reference to the plurality of inner spiral blade pieces. Using the downstream spiral blade, it is possible to suppress the developer from being retained around the discharge port portion of the rotation tube, and to smoothly flow the developer around the first communication path. As a result, it is possible to suppress stress generated in the developer.

The technology provides an electrophotographic image forming apparatus including the developing device mentioned above.

According to this configuration, as the image forming apparatus includes the developing device as described above, it is possible to form an excellent image in which image density unevenness is suppressed.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
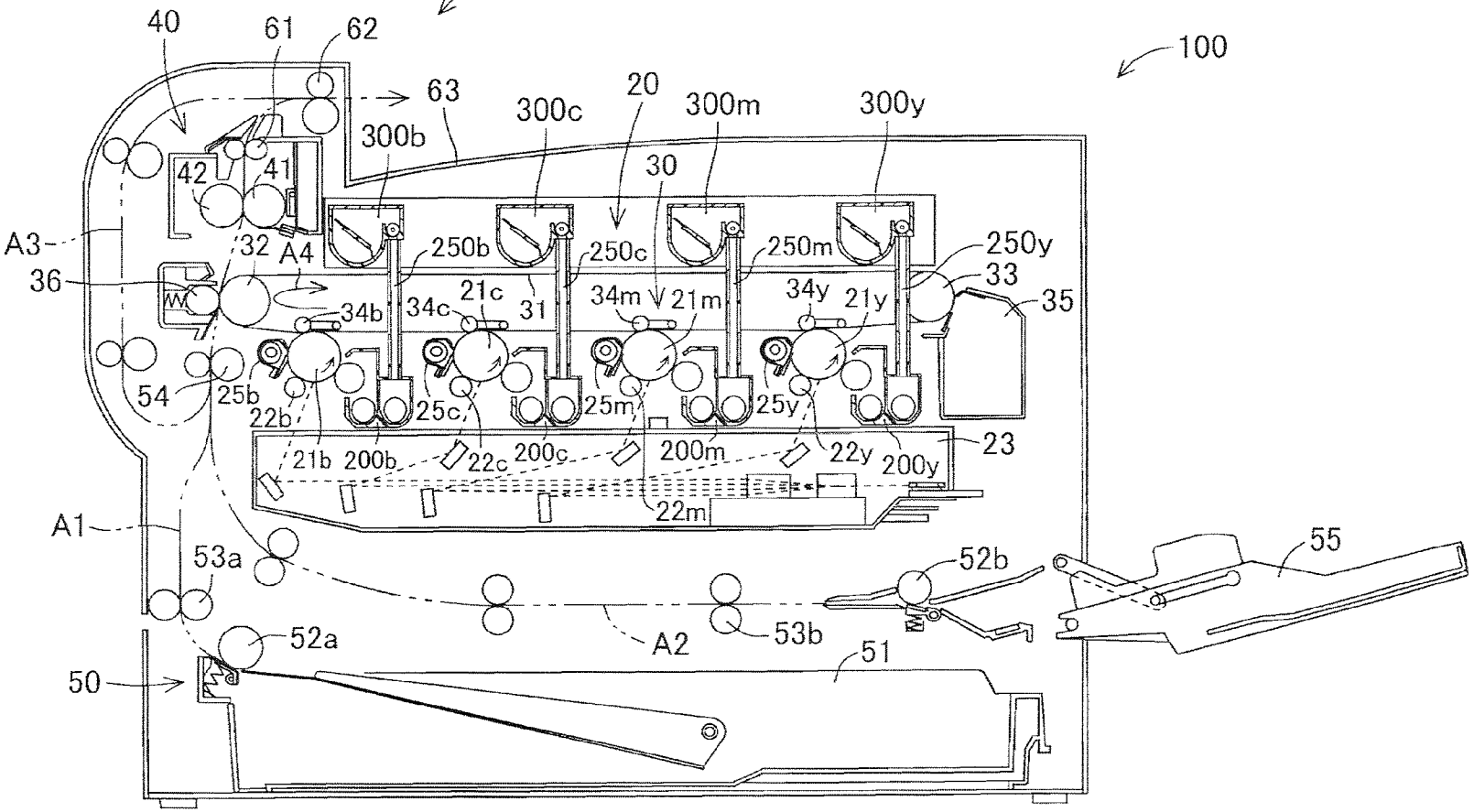
FIG. 1 is a schematic view illustrating a configuration of an image forming apparatus.

Now referring to the drawings, preferred embodiments are described below.

First, an image forming apparatus 100 including a developing device 200 according to an embodiment will be described. FIG. 1 is a schematic view illustrating a configuration of the image forming apparatus 100. The image forming apparatus 100 is a multi-functional peripheral having a copying function, a printing function, and a facsimile function, and forms a full color image or a monochrome image on a recording medium according to transferred image information.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, toner cartridges 300*b*, 300*c*, 300*m*, and 300*y*, and toner supplying pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250, and the intermediate transfer roller 34 are disposed for each color to correspond to image information of each color of black (b), cyan (c), magenta (m), and yellow (y) included in color image information. In this specification, in a case where four members corresponding to the colors, respectively, are discriminated, a letter representing each color is attached to the end of a numeral representing each member and this is used as a reference numeral, and in a case where each of the members are collectively referred to, only the numeral representing each of the members is used as a reference numeral.

The photoreceptor drum 21 is supported by a driving unit (not shown) so as to be rotatable around an axial line thereof, and includes a conductive substrate (not shown), and a photoconductive layer formed on a surface of the conductive substrate.

The charging section 22, the developing device 200, and the cleaning unit 25 are disposed in this order along the rotation direction of the photoreceptor drum 21, and the charging section 22 is disposed on a vertically lower side in relation to the developing device 200 and the cleaning unit 25.

The charging section 22 is a device that charges the surface of the photoreceptor drum 21 at predetermined polarity and potential. The charging section 22 is disposed at a position facing the photoreceptor drum 21 along the longitudinal direction of the photoreceptor drum 21.

The exposure unit 23 is disposed so that light emitted from the exposure unit 23 passes between the charging section 22 and the developing device 200 and the surface of the photoreceptor drum 21 is irradiated with the light.

The developing device 200 is a device that develops the electrostatic latent image formed on the photoreceptor drum 21 with a toner, and thereby forms a toner image on the photoreceptor drum 21. A toner supplying pipe 250 that is a cylindrical member is connected to the developing device 200 at a vertically upper part thereof. The details of the developing device 200 will be described later.

The toner cartridge 300 is displaced on a vertically upper side in relation to the developing device 200, and contains an unused toner. The toner supplying pipe 250 is connected to the toner cartridge 300 at a vertically lower part thereof. The toner cartridge 300 supplies the toner to the developing device 200 through the toner supplying pipe 250. The details of the toner cartridge 300 will be described later.

The cleaning unit 25 is a member that removes the toner remaining on the surface of the photoreceptor drum 21 after transferring the toner image onto the intermediate transfer belt 31 from the photoreceptor drum 21 and thereby cleans the surface of the photoreceptor drum 21.

According to the toner image forming section 20, the surface of the photoreceptor drum 21, that is in a uniformly charged state by the charging section 22, is irradiated with laser light corresponding to image information from the exposure unit 23, and thereby an electrostatic latent image is formed thereon. The toner is supplied to the electrostatic latent image on the photoreceptor drum 21 from the developing device 200, and thereby a toner image is formed. The toner image is transferred onto the intermediate transfer belt 31 described later. After the toner image is transferred onto the intermediate transfer belt 31, the toner remaining on the surface of the photoreceptor drum 21 is removed by the cleaning unit 25.

The intermediate transfer belt 31 is an endless belt-like member disposed vertically above the photoreceptor drum 21. The intermediate transfer belt 31 is supported around a driving roller 32 and a driven roller 33 with tension and forms a loop-like pathway, and runs in a direction indicated by an arrow A4.

The driving roller 32 is disposed to be rotatable around a axial line thereof by a driving unit (not shown). The driving roller 32 allows the intermediate transfer belt 31 to run in the direction indicated with the arrow A4 by rotation thereof. The driven roller 33 is provided to be rotatable in accordance with rotation of the driving roller 32, and generates a constant tension to the intermediate transfer belt 31 so that the intermediate transfer belt 31 does not go slack.

The intermediate transfer roller 34 is provided to come into pressure-contact with the photoreceptor drum 21 with the intermediate transfer belt 31 interposed therebetween and to be rotatable around an axial line thereof by a driving unit (not shown). As the intermediate transfer roller 34, for example, a roller member including a conductive elastic member on a surface of a metal (for example, stainless steel) roller having a diameter of 8 mm to 10 mm may be used. The intermediate transfer roller 34 is connected to a power source (not shown) that applies a transfer bias and has a function of transferring the toner image formed on the surface of the photoreceptor drum 21 to the intermediate transfer belt 31.

The transfer roller 36 is provided to come into pressure-contact with the driving roller 32 with the intermediate transfer belt 31 interposed therebetween, and to be rotatable around an axial line thereof by a driving unit (not shown). At a pressure-contact portion (transfer nip region) between the transfer roller 36 and the driving roller 32, the toner image borne on and conveyed by the intermediate transfer belt 31 is transferred onto a recording medium fed from the recording medium feeding section 50 described later.

The transfer belt cleaning unit 35 is provided to be opposite to the driven roller 33 in relation to the intermediate transfer belt 31, and to come into contact with a toner bearing surface of the intermediate transfer belt 31. The transfer belt cleaning unit 35 is provided to remove the toner on the surface of the intermediate transfer belt 31 and recovers the removed toner after the transfer of the toner image onto the recording medium.

According to the transfer section 30, when the intermediate transfer belt 31 runs while being brought into contact with the photoreceptor drum 21, a transfer bias with a polarity opposite to the charging polarity of the toner on the surface of the photoreceptor drum 21 is applied to the intermediate transfer roller 34, and the toner image formed on the surface of the photoreceptor drum 21 is transferred onto the intermediate transfer belt 31. The toner images of the respective colors formed by the photoreceptor drum 21*y*, the photoreceptor drum 21*m*, the photoreceptor drum 21*c*, and the photoreceptor drum 21*b* are sequentially overlaid and transferred onto the intermediate transfer belt 31 in this order and thereby a full color toner image is formed. The toner image transferred onto the intermediate transfer belt 31 is conveyed to the transfer nip region by running of the intermediate transfer belt 31 and is transferred onto a recording medium at the transfer nip region. The recording medium having the toner image transferred thereto is conveyed to the fixing section 40 described later.

The recording medium feeding section 50 includes a paper feed box 51, pick-up rollers 52*a* and 52*b*, conveying rollers 53*a* and 53*b*, registration rollers 54, and a paper feed tray 55. The paper feed box 51 is a container-like member that is provided at a vertically lower part of the image forming apparatus 100 and stores recording mediums at the inside of the image forming apparatus 100. The paper feed tray 55 is a tray-like member that is provided in a side wall surface of the image forming apparatus 100 and stores recording mediums at the outside of the image forming apparatus 100.

The pick-up roller 52*a* is a member that takes out the recording mediums stored in the paper feed box 51 one by one and feeds it to a paper conveyance path A1. The conveying rollers 53*a* are a pair of roller-like members, which are provided to come into pressure-contact with each other, and convey the recording medium in the paper conveyance path A1 toward the registration rollers 54. The pick-up roller 52*b* is a member that takes out the recording mediums stored in the paper feed tray 55 one by one and feeds it to a paper conveyance path A2. The conveying rollers 53*b* are a pair of roller-like members, which are provided to come into pressure-contact with each other, and convey the recording medium in the paper conveyance path A2 toward the registration rollers 54.

The registration rollers 54 are a pair of roller-like members, which are provided to come into pressure-contact with each other, and feeds the recording medium fed from the conveying rollers 53*a* or 53*b* to the transfer nip region in synchronization with conveyance of the toner image borne on the intermediate transfer belt 31 to the transfer nip region.

According to the recording medium feeding section 50, in synchronization with conveyance of the toner image borne on the intermediate transfer belt 31 to the transfer nip region, the recording medium is fed to the transfer nip region from the paper feed box 51 or the paper feed tray 55 and then the toner image is transferred onto the recording medium.

The fixing section 40 includes a heating roller 41 and a pressure roller 42. The heating roller 41 is controlled to maintain a predetermined fixing temperature. The pressure roller 42 is a roller that comes into pressure-contact with the heating roller 41. The heating roller 41 nips the recording medium together with the pressure roller 42 while heating the recording medium, and melts toner constituting the toner image and fixes it onto the recording medium. The recording medium having the toner image fixed thereon is conveyed to the discharge section 60 described later.

The discharge section 60 includes conveying rollers 61, discharge rollers 62, and a catch tray 63. The conveying rollers 61 are a pair of roller-like members, which are provided to come into pressure-contact with each other on a vertically upper side of the fixing section 40. The conveying rollers 61 convey the recording medium having an image fixed thereon toward the discharge rollers 62.

The discharge rollers 62 are a pair of roller-like members, which are provided to come into pressure-contact with each other. In the case of one-sided printing, the discharge rollers 62 discharge the recording medium on which the one-sided printing is completed to the catch tray 63. In the case of double-sided printing, the discharge rollers 62 convey the recording medium on which the one-sided printing is completed to the registration rollers 54 through a paper conveyance path A3 and discharges the recording medium on which the double-sided printing is completed to the catch tray 63. The catch tray 63 is provided in the vertically top surface of the image forming apparatus 100 and stores the recording mediums having the image fixed thereon.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD).

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
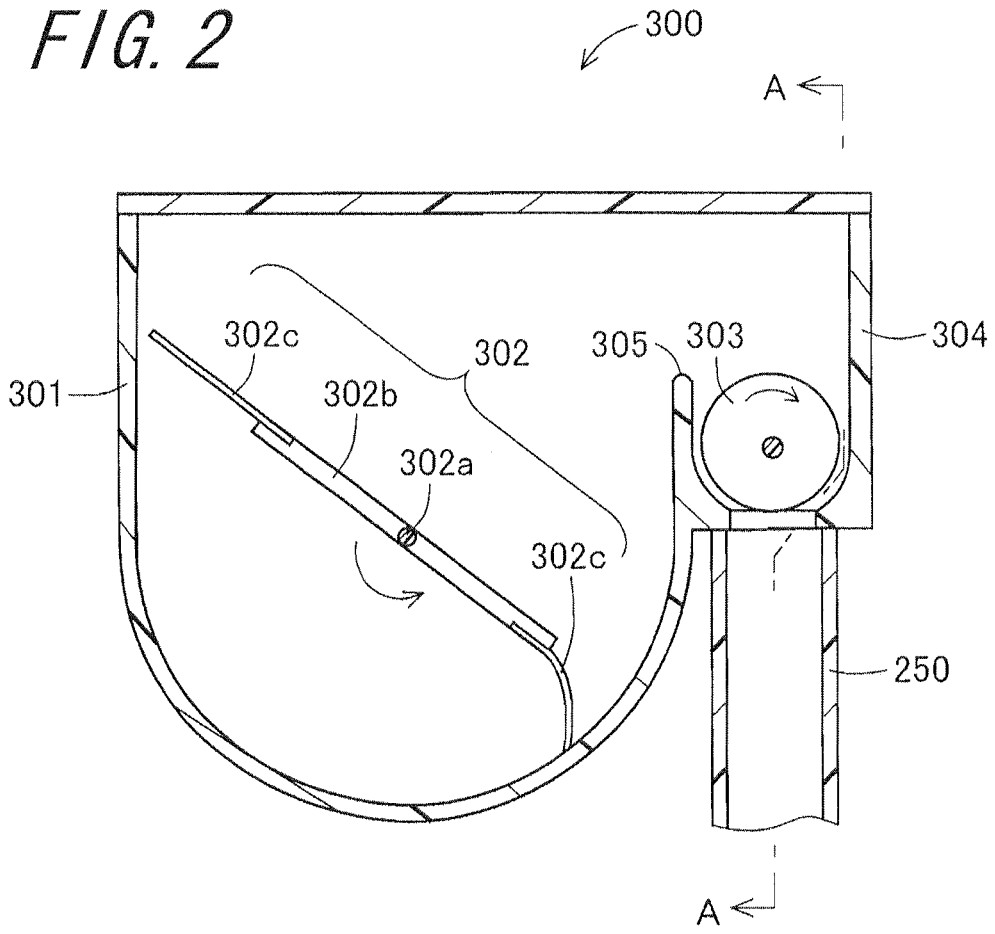
FIG. 2 is a schematic view illustrating a configuration of a toner cartridge.
Figure 3:
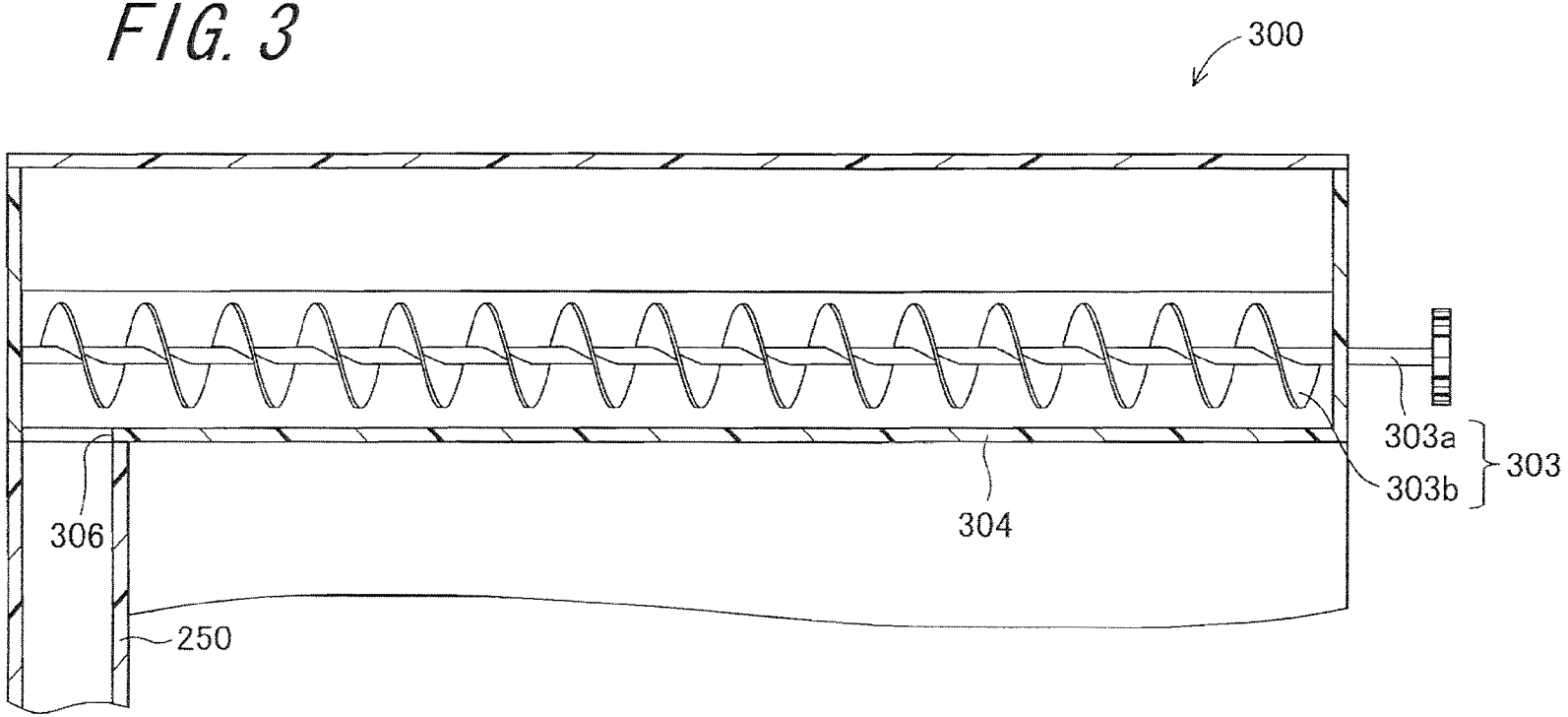
FIG. 3 is a cross-sectional view of the toner cartridge taken along the line A-A shown in FIG. 2.

FIG. 2 is a schematic view illustrating a configuration of the toner cartridge 300. FIG. 3 is a cross-sectional view of the toner cartridge 300 taken along the line A-A shown in FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both end parts in the width direction of the base member 302*b*, and is formed of, for example, a polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* provided at the both end parts in the width direction of the base member 302*b* slides on an inner wall face of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* provided around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
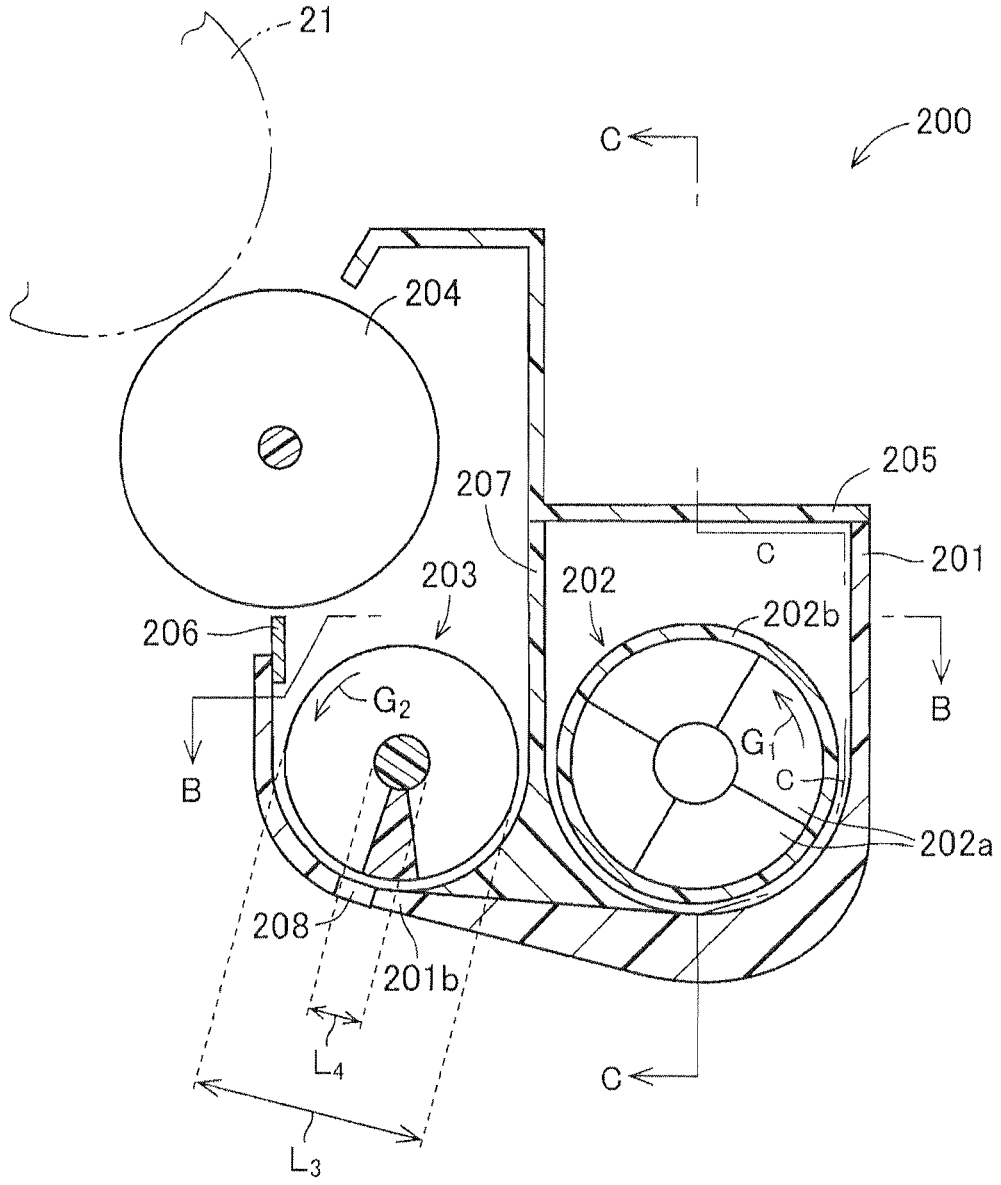
FIG. 4 is a schematic view illustrating a configuration of a developing device.
Figure 5:
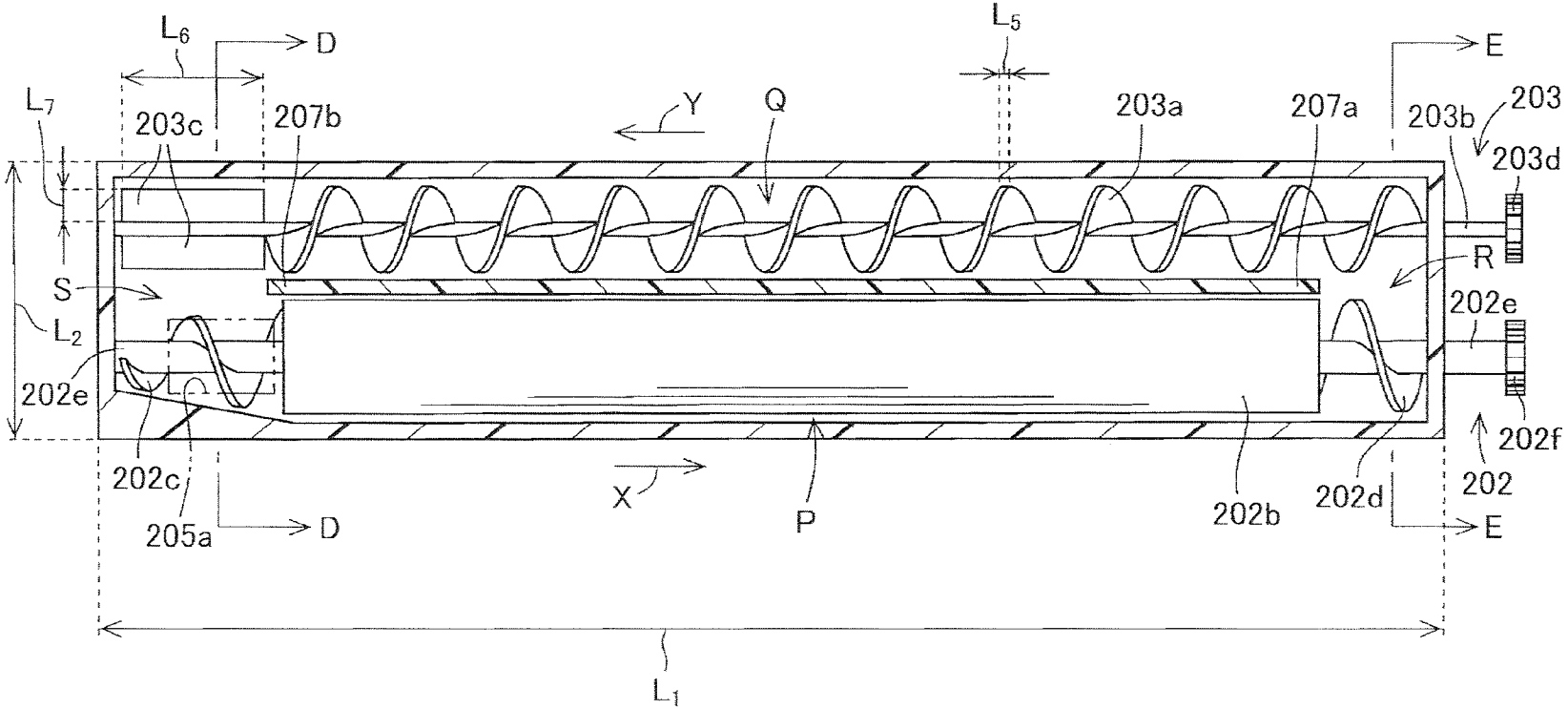
FIG. 5 is a cross-sectional view of the developing device taken along the line B-B shown in FIG. 4.
Figure 6:
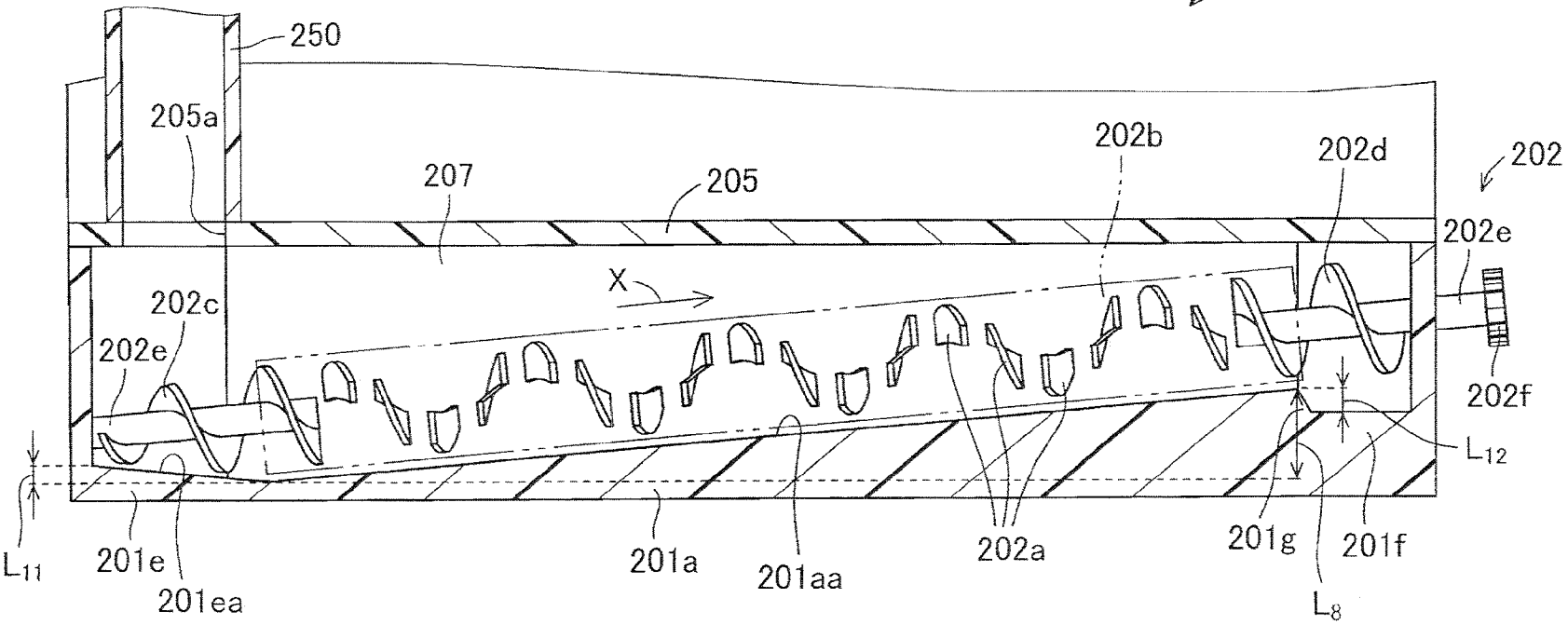
FIG. 6 is a cross-sectional view of the developing device taken along the line C-C shown in FIG. 4.
Figure 7:
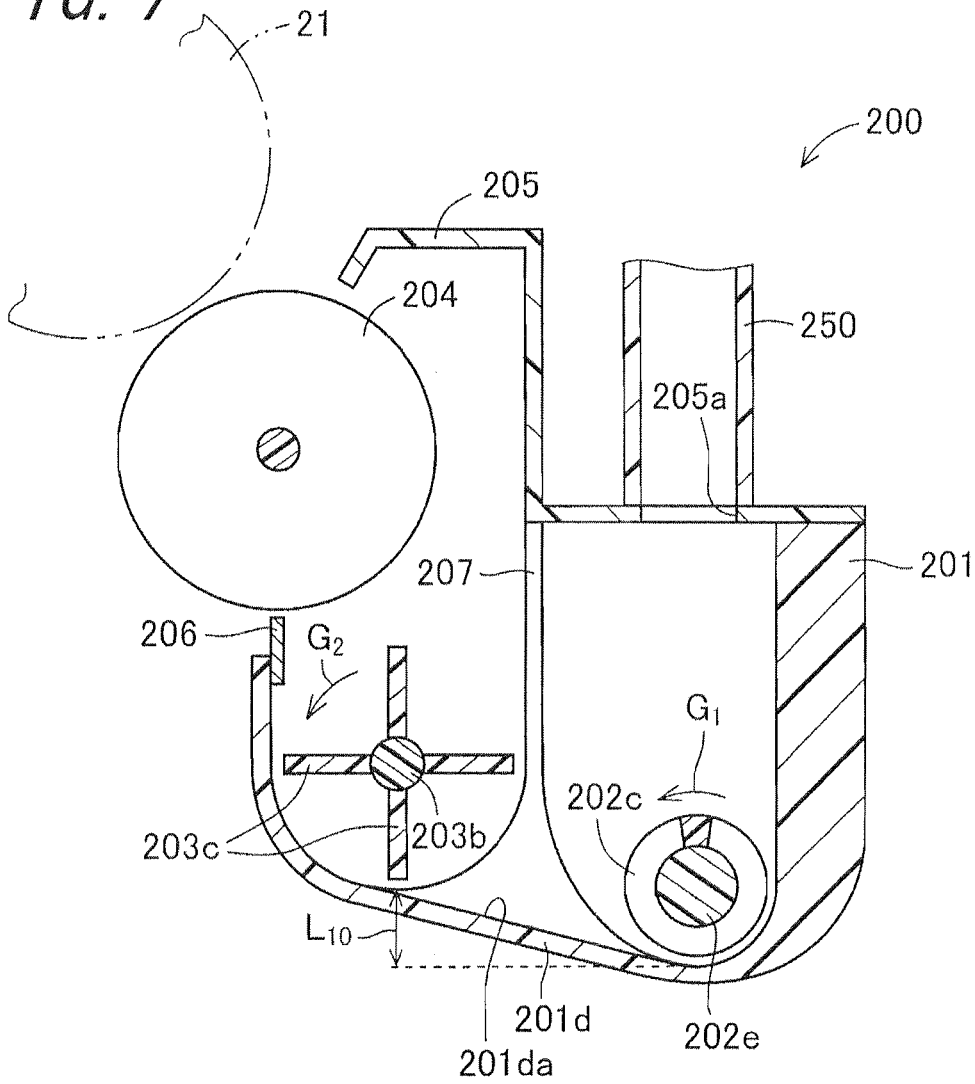
FIG. 7 is a cross-sectional view of the developing device taken along the line D-D shown in FIG. 5.
Figure 8:
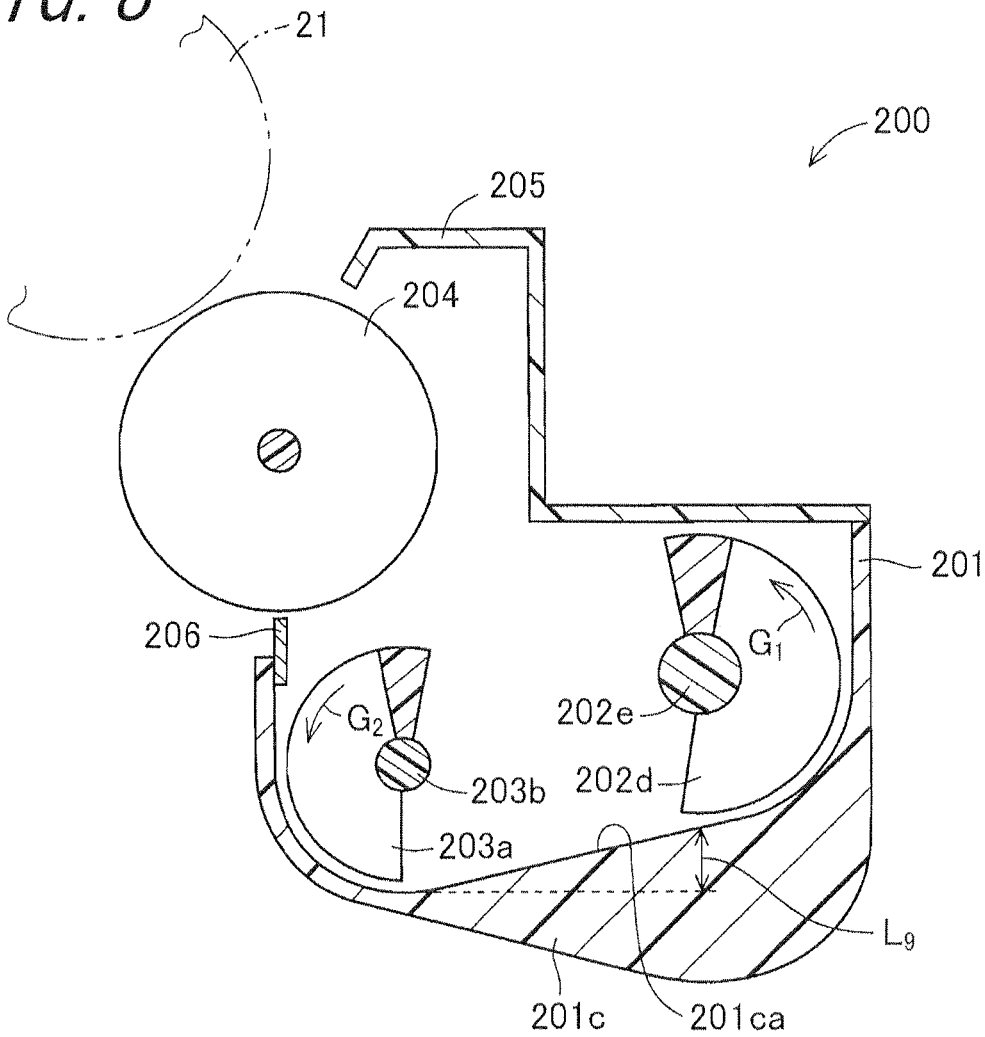
FIG. 8 is a cross-sectional view of the developing device taken along the line E-E shown in FIG. 5.

FIG. 4 is a schematic view illustrating a configuration of the developing device 200. FIG. 5 is a cross-sectional view of the developing device 200 taken along the line B-B shown in FIG. 4. FIG. 6 is a cross-sectional view of the developing device 200 taken along the line C-C shown in FIG. 4. FIG. 7 is a cross-sectional view of the developing device 200 taken along the line D-D shown in FIG. 5. FIG. 8 is a cross-sectional view of the developing device 200 taken along the line E-E shown in FIG. 5. The developing device 200 is a device which supplies a toner onto a surface of the photoreceptor drum 21 so as to develop an electrostatic latent image formed on the surface thereof. The developing device 200 includes a developer tank 201, a first developer conveying section 202, a second developer conveying section 203, a developing roller 204, a developer tank cover 205, a doctor blade 206, a partition wall 207, and a toner concentration detection sensor 208.

The developer tank 201 is a member having an internal space, and contains a developer in the internal space. The developer used in this embodiment may be a one-component developer composed only of a toner, or may be a two-component developer containing a toner and a carrier.

In the developer tank 201, the developer tank cover 205 is disposed on a vertically upper side, and in the internal space thereof, the first developer conveying section 202, the second developer conveying section 203, the developing roller 204, the doctor blade 206, and the partition wall 207 are disposed. Further, in a vertically lower part (bottom part) of the developer tank 201, the toner concentration detection sensor 208 is disposed. Further, the developer tank 201 has an opening section between the photoreceptor drum 21 and the developing roller 204.

A length $L_1$ of the developer tank 201 in the longitudinal direction thereof falls within a range of about 350 mm to 400 mm. Moreover, a length $L_2$ of the developer tank 201 in a width direction thereof falls within a range of about 50 mm to 70 mm.

The developing roller 204 includes a magnet roller, and bears the developer inside the developer tank 201 on a surface thereof and supplies the toner contained in the borne developer to the photoreceptor drum 21. To the developing roller 204, a power source (not shown) is connected and a developing bias voltage is applied. The toner borne on the developing roller 204 is, in the vicinity of the photoreceptor drum 21, moved to the photoreceptor drum 21 with an electrostatic force by the developing bias voltage.

The doctor blade 206 is a plate-like member extending along an axial line direction of the developing roller 204, and is provided so that one end in a width direction thereof is fixed to the developer tank 201, and another end thereof has a clearance with respect to the surface of the developing roller 204. The doctor blade 206 is provided so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The partition wall 207 is a member having a longitudinal shape extending along the longitudinal direction of the developer tank 201 at the substantially center portion of the developer tank 201 in the width direction thereof. The partition wall 207 is provided between the bottom of the developer tank 201 and the developer tank cover 205 so that both longitudinal ends are spaced from an inner wall surface of the developer tank 201. Due to the partition wall 207, the internal space of the developer tank 201 is partitioned into a first conveying path P, a second conveying path Q, a first communication path R, and a second communication path S.

The second conveying path Q is an approximately semi-circular cylindrical space which extends along a longitudinal direction of the partition wall 207 and faces the developing roller 204. The first conveying path P is an approximately semi-circular cylindrical space which extends along the longitudinal direction of the partition wall 207 and is opposed to the second conveying path Q with the partition wall 207. The first communication path R is a space communicating with the first and second conveying paths P and Q on a side of one longitudinal end 207*a* of the partition wall 207. The second communication path S is a space communicating with the first and second conveying paths P and Q on a side of another longitudinal end 207*b* of the partition 207.

The developer tank cover 205 is detachably disposed on a vertically upper side of the developer tank 201, and has a supply port portion 205*a*. To the developer tank cover 205, at the supply port portion 205*a*, the toner supply pipe 250 is connected. The supply port portion 205*a* is an opening portion defining an opening for supplying a toner into the developer tank 201. The toner contained in the toner cartridge 300 is supplied into the developer tank 201 through the toner supply pipe 250 and the opening.

The supply port portion 205*a* is formed around the second communication path S on a vertically upper side of the first conveying path P. More specifically, the supply port portion 205*a* faces the first conveying path P, and is formed in the same position as that of the second communication path S in the longitudinal direction of the partition wall 207. The opening formed in the supply port portion 205*a* has an approximately rectangular shape in which the long side length thereof is about 20 mm to 30 mm and the short side length thereof is about 15 mm to 20 mm.

The first developer conveying section 202 is disposed inside the first conveying path P. The first developer conveying section 202 conveys the developer inside the developer tank 201 toward the side of the another longitudinal end 207*a* of the partition wall 207 from the side of the one longitudinal end 207*b* of the partition wall 207. Hereinafter, a conveying direction of the developer by the first developer conveying section 202 is referred to as a conveying direction X.

The first developer conveying section 202 includes a plurality of inner spiral blade pieces 202*a*, a rotation tube 202*b*, an upstream spiral blade 202*c*, a downstream spiral blade 202*d*, two support members 202*e*, and a first gear 202*f*. The first developer conveying section 202 extends in the conveying direction X as a whole, and respectively includes the cylindrical support member 202*e* on the upstream side and the downstream side in the conveying direction X. Among the two support members 202*e*, the support member 202*e* on the upstream side in the conveying direction X is rotatably supported by the inner wall of the developer tank 201. Among the two support members 202*e*, the support member 202*e* on the downstream side in the conveying direction X is connected to the first gear 202*f* outside the developer tank 201.

The plurality of inner spiral blade pieces 202*a* has a form of winding around the side surface of an imaginary circular column which extends in the conveying direction X, and rotates in a rotation direction $G_1$ at 60 rpm to 180 rpm around an axial line of the imaginary circular column, through the rotation tube 202*b*, the upstream spiral blade 202*c*, the downstream spiral blade 202*d*, the support members 202*e*, and the first gear 202*f*, by a driving section such as a motor. The developer stored in the first conveying path P is conveyed downstream in the conveying direction X, by the rotation of the plurality of inner spiral blade pieces 202*a*, as a whole. Since the supply port portion 205*a* of the developer tank cover 205 is formed around the second communication path S on the vertically upper side of the first conveying path P, unused toner in the toner cartridge 300 is firstly supplied to the first conveying path P, and then, is conveyed downstream the first conveying path P in the conveying direction X by the first developer conveying section 202.

The rotation tube 202*b* is a hollow member which surrounds an outer circumferential portion of the plurality of inner spiral blade pieces 202*a* and rotates with the plurality of inner spiral blade pieces 202*a*. The rotation tube 202*b* extends in the conveying direction X, and has holes formed in an upstream end thereof and a downstream end thereof in the conveying direction X.

The upstream spiral blade 202*c* is fixed to the upstream end of the rotation tube 202*b* in the conveying direction X, and rotates with the rotation tube 202*b*, so that the upstream spiral blade 202*c* conveys the developer existing outside the rotation tube 202*b*, more specifically, which existing around the hole on the upstream side of the rotation tube 202*b* in the conveying direction X, downstream in the conveying direction X. Thus, the upstream spiral blade 202*c* guides the developer existing outside the rotation tube 202*b* to the hole on the upstream side of the rotation tube 202*b* in the conveying direction X. The developer guided to the hole is conveyed downstream in the conveying direction X by the plurality of inner spiral blade pieces 202*a*.

The downstream spiral blade 202*d* is fixed to the downstream end of the rotation tube 202*b* in the conveying direction X, and rotates with the rotation tube 202*b*, so that the downstream spiral blade 202*d* conveys the developer existing outside the rotation tube 202*b*, more specifically, which exists around the hole on the downstream side of the rotation tube 202*b* in the conveying direction X, downstream in the conveying direction X. Thus, the downstream spiral blade 202*d* guides the developer existing outside the rotation tube 202*b* to the first communication path R. The developer guided to the first communication path R moves to the second conveying path Q through the first communication path R.

The second developer conveying section 203 is disposed inside the second conveying path Q. The second developer conveying section 203 conveys the developer inside the developer tank 201 from the side of the one longitudinal end 207*a* to the side of the another longitudinal end 207*b* of the partition wall 207. Hereinafter, a conveying direction of the developer by the second developer conveying section 203 is referred to as a conveying direction Y.

The second developer conveying section 203 includes a second spiral blade 203*a*, a rotation shaft member 203*b*, four circumferential rotation plates 203*c* and a second gear 203*d*. The rotation shaft member 203*b* is a cylindrical member which extends along the conveying direction Y, one longitudinal end thereof is connected to the second gear 203*d* outside the developer tank 201, and another longitudinal end thereof is rotatably supported by the inner wall of the developer tank 201.

The second spiral blade 203*a* has a shape that is spirally wound on a side surface of the rotation shaft member 203*b*, and rotates around an axial line of the rotation shaft member 203*b* in a rotation direction $G_2$ at 60 to 180 rpm by a driving unit such as a motor via the rotation shaft member 203*b* and the second gear 203*d*. The developer stored in the second conveying path Q is conveyed downstream in the conveying direction Y by rotation of the second spiral blade 203*a*.

The four circumferential rotation plates 203*c* are composed of rectangular flat plates in the same shape, and long side portions thereof are fixed to the rotation shaft member 203*b*. The four circumferential rotation plates 203*c* are fixed to the rotation shaft member 203*b* so that main surfaces of the two neighboring circumferential rotation plates 203*c* are orthogonal to each other, and rotates with the second spiral blade 203*a* around an axial line of the rotation shaft member 203*b* in the rotation direction $G_2$. The developer conveyed from an upstream side in the conveying direction Y in the second conveying path Q is forced to the side of the second communication path S by rotation of the circumferential rotation plates 203*c*, and moves into the first conveying path P. Note that, as another embodiment, the second developer conveying section 203 may be an auger screw-like member without the circumferential rotation plates 203*c*.

A value of two times a distance from the axial line of the rotation shaft member 203*b* to a point, which is farthest from the axial line, on the second spiral blade 203*a* is referred to as an external diameter $L_3$ of the second spiral blade 203*a*. In addition, a value of two times a distance from the axial line of the rotation shaft member 203*b* to a point, which is nearest to the axial line, on the second spiral blade 203*a* is referred to as an internal diameter $L_4$ of the second spiral blade 203*a*. The external diameter $L_3$ of the second spiral blade 203*a* is settable as appropriate within a range of 20 mm or more and 40 mm or less, and the internal diameter $L_4$ of the second spiral blade 203*a* is settable as appropriate within a range of 5 mm or more and 10 mm or less. In addition, a thickness of $L_5$ of the second spiral blade 203*a* is settable as appropriate within a range of 1 mm or more and 3 mm or less. In addition, a length $L_6$ of the long side portion of the circumferential rotation plate 203*c* is settable as appropriate within a range of 20 mm or more and 40 mm or less, and a length $L_7$ of a short side portion of the circumferential rotation plate 203*c* is settable as appropriate within a range of 5 mm or more and 20 mm or less.

The toner concentration detection sensor 208 is mounted in the bottom of the developer tank 201 on a vertically lower side of the second developer conveying section 203, and is disposed so that a sensing surface thereof is exposed to the second conveying path Q. The toner concentration detection sensor 208 is electrically connected to a toner concentration control section (not shown).

The toner concentration control section performs control of rotating a toner discharge member 303 of the toner cartridge 300 according to the toner concentration detecting result detected by the toner concentration detection sensor 208 and supplying the toner into the developer tank 201. More specifically, the toner concentration control section determines whether the toner concentration detecting result through the toner concentration detection sensor 208 is lower than a predetermined set value. In a case where it is determined that the toner concentration detecting result is lower than the predetermined set value, the toner concentration control section sends a control signal to a driving section which rotates the toner discharge member 303, and rotates the toner discharge member 303 for a predetermined period.

To the toner concentration detection sensor 208, a power source (not shown) is connected. The power source applies, to the toner concentration detection sensor 208, a driving voltage for driving the toner concentration detection sensor 208 and a control voltage for outputting the toner concentration detection result to the toner concentration control section. The application of the voltage to the toner concentration detection sensor 208 by the power source is controlled by a control unit (not shown).

As the toner concentration detection sensor 208, a general toner concentration detection sensor is usable, and examples thereof include a transmissive optical detection sensor, a reflective optical detection sensor, and a permeability detection sensor. Among the toner concentration detection sensors, it is preferable to use the permeability detection sensor. Examples of the permeability detection sensor include TS-L (trade name, manufactured by TDK corporation), TS-A (trade name, manufactured by TDK corporation), and TS-K (trade name, manufactured by TDK corporation).

Hereinafter, a portion which faces the central part of the first conveying path P in the conveying direction X, of the bottom part of the developer tank 201, is referred to as a first conveying path central bottom part 201*a*, and a portion thereof which faces the upstream part of the first conveying path P in the conveying direction X is referred to as a first conveying path-upstream region bottom part 201*e*. Further, a portion which faces the downstream part of the first conveying path P in the conveying direction X, of the bottom part of the developer tank 201, is referred to as a first conveying path-downstream region bottom part 201*f*, and a portion between the first conveying path-downstream region bottom part 201*f* and the first conveying path central bottom part 201*a* is referred to as a barrier part 201*g*. Further, a portion which faces the second conveying path Q, of the bottom part of the developer tank 201, is referred to as a second conveying path bottom part 201*b*, a portion thereof which faces the first communication path R is referred to as a first communication path bottom part 201*c*, and a portion thereof which faces the second communication path S is referred to as a second communication path bottom part 201*d*.

A vertically upper surface 201*aa* of the first conveying path central bottom part 201*a* extends to be inclined with reference to the horizontal direction so that a portion on the downstream side thereof in the conveying direction X is disposed vertically above a portion on the upstream side thereof in the conveying direction X. The distance $L_8$ in the vertical direction between the upstream end of the vertically upper surface 201*aa* of the first conveying path central bottom part 201*a* in the conveying direction X and the downstream end thereof in the conveying direction X is settable as appropriate within a range of 10 mm or more and 30 mm or less. The axial line of the imaginary circular column which is wound by the plurality of inner spiral blade pieces 202*a* extends along the vertically upper surface 201*aa* of the first conveying path central bottom part 201*a*, and is thus inclined with reference to the horizontal direction. Further, the length of the vertically upper surface 201*aa* in the longitudinal direction of the first conveying path central bottom part 201*a* is almost the same as the length $L_{19}$ in the axial line direction of the rotation tube 202*b* (which will be described later). A vertically upper surface of the second conveying path bottom part 201*b* extends along the horizontal direction, while the vertically upper surface 201*aa* of the first conveying path central bottom part 201*a* extends to be inclined.

The first communication path bottom part 201*c* is disposed between the first conveying path-downstream region bottom part 201*f* and the second conveying path bottom part 201*b*. A vertically upper surface 201*ca* of the first communication path bottom part 201*c* extends to be inclined so that a portion thereof on the side of the first conveying path-downstream region bottom part 201*f* is disposed vertically above a portion thereof on the side of the second conveying path bottom part 201*b*. The distance $L_9$ in the vertical direction between an end of the vertically upper surface 201*ca* of the first communication path bottom part 201*c* on the side of the second conveying path bottom part 201*b* and an end thereof on the side of the first conveying path-downstream region bottom part 201*f* is settable as appropriate within a range of 5 mm or more and 15 mm or less.

The second communication path bottom part 201*d* is disposed between the first conveying path-upstream region bottom part 201*e* and the second conveying path bottom part 201*b*. A vertically upper surface 201*da* of the second communication path bottom part 201*d* extends to be inclined so that a portion thereof on the side of the second conveying path bottom part 201*b* is disposed vertically above a portion thereof on the side of the first conveying path-upstream region bottom part 201*e*. The distance $L_{10}$ in the vertical direction between an end of the vertically upper surface 201*da* of the second communication path bottom part 201*d* on the side of the first conveying path-upstream region bottom part 201*e* and an end thereof on the side of the second conveying path bottom part 201*b* is settable as appropriate within a range of 5 mm or more and 15 mm or less.

A vertically upper surface 201*ea* of the first conveying path-upstream region bottom part 201*e* extends to be inclined so that a portion thereof on the upstream side in the conveying direction X is disposed vertically above a portion thereof on the downstream side in the conveying direction X. The distance $L_{11}$ in the vertical direction between an end of the vertically upper surface 201*ea* of the first conveying path-upstream region bottom part 201*e* on the downstream side in the conveying direction X and an end thereof on the upstream side in the conveying direction X is settable as appropriate within a range of 3 mm or more and 10 mm or less.

The barrier part 201*g* is adjacent to the first conveying path-downstream region bottom part 201*f* on the upstream side in the conveying direction X with reference to the first conveying path-downstream region bottom part 201*f*. Further, the barrier part 201*g* is formed to be protruded vertically above the first conveying path-downstream region bottom part 201*f*. The distance $L_{12}$ in the vertical direction between the first conveying path-downstream region bottom part 201*f* and the barrier part 201*g* is settable as appropriate within a range of 3 mm or more and 10 mm or less.

According to the developing device 200 configured in this manner, the developer is circulation-conveyed through the internal of the developer tank 201 in a circulation order composed of the first conveying path P, the first communication path R, the second conveying path Q, and the second communication path S. Part of the developer which is being circulation-conveyed is borne on the surface of the developing roller 204 in the second conveying path Q. Having reached the photoreceptor drum 21, toner constituents of the borne developer are consumed one after another. When the toner concentration detection sensor 208 senses the consumption of predetermined amounts of toner, then unused toner is supplied from the toner cartridge 300 into the first conveying path P. The supplied toner is conveyed in the first conveying path P while spreading into the existing developer in storage.

Figure 9:
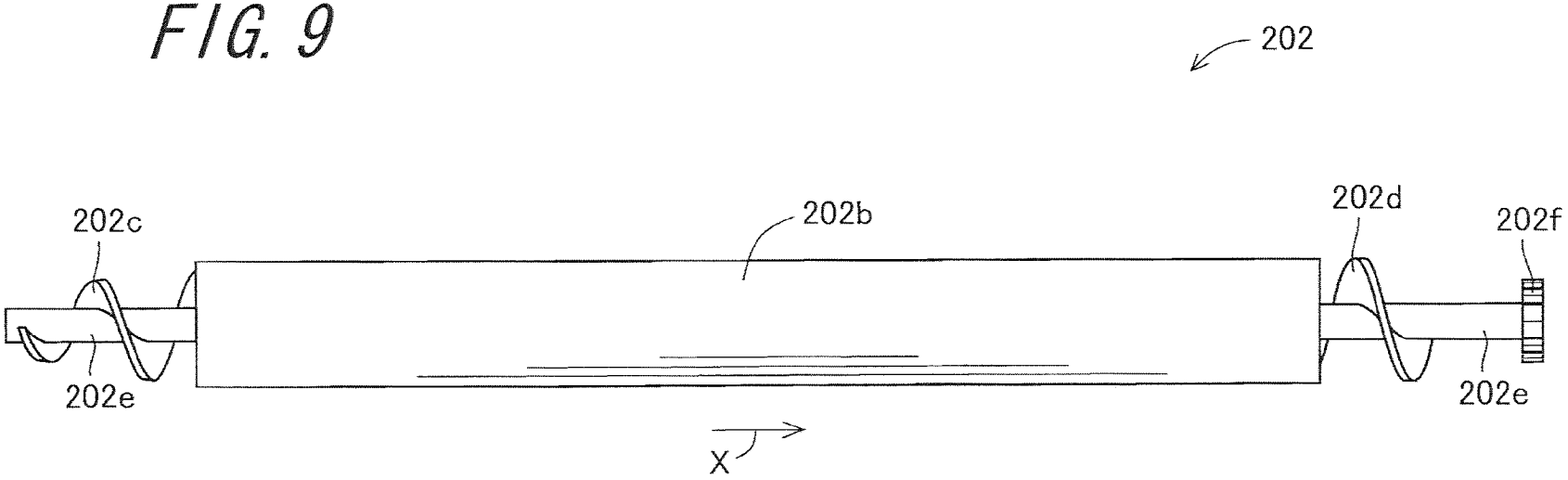
FIG. 9 is a diagram schematically illustrating a first developer conveying section as a whole.
Figure 10:
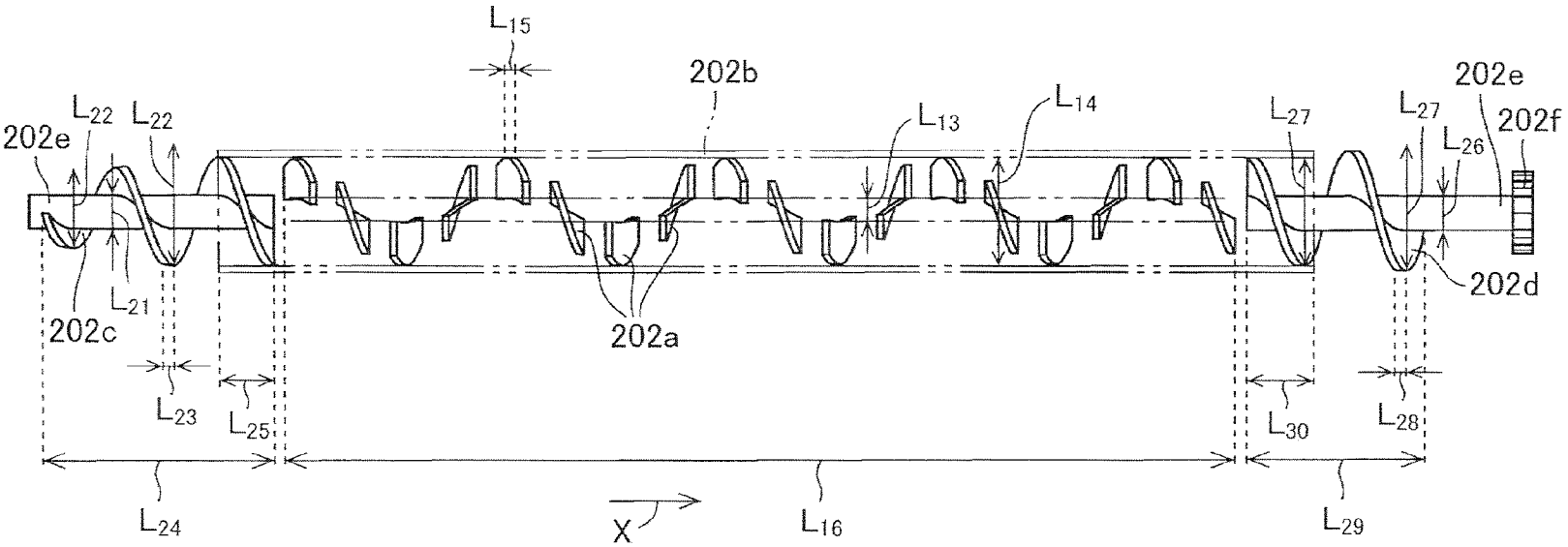
FIG. 10 is a diagram schematically illustrating an inside of a rotation tube.

Hereinafter, the first developer conveying section 202 will be described in detail. FIG. 9 is a diagram schematically illustrating the first developer conveying section 202 as a whole. FIG. 10 is a diagram schematically illustrating the inside of the rotation tube 202*b*. As described above, the first developer conveying section 202 includes the plurality of inner spiral blade pieces 202*a*, the rotation tube 202*b*, the upstream spiral blade 202*c*, the downstream spiral blade 202*d*, the two support members 202*e*, and the first gear 202*f*.

The inner spiral blade pieces 202*a*, the rotation tube 202*b*, the upstream spiral blade 202*c*, the downstream spiral blade 202*d*, the support members 202*e*, and the first gear 202*f* are formed of a material such as polyethylene, polypropylene, high impact polystyrene, or ABS resin (acrylonitrile-butadiene-styrene copolymer synthetic resin). In a case where the materials of the inner spiral blade pieces 202*a*, the rotation tube 202*b*, the upstream spiral blade 202*c*, the downstream spiral blade 202*d*, the support members 202*e*, and the first gear 202*f* are the same, it is preferable that the first developer conveying section 202 be integrally formed.

The inner spiral blade pieces which form the embodiment (inner spiral blade pieces 202*a*) are spiral blade pieces which are fixed to the inner peripheral wall of the rotation tube 202*b*. In this embodiment, "spiral blade piece" refers to a member having a predetermined thickness which has the spiral blade surface as a main surface and forms a part of the spiral blade. The spiral blade refers to a blade portion of an auger screw, for example.

In this embodiment, the "spiral blade surface" is a curved surface which is wound around the side surface of the imaginary circular column in a spiral form, and is a curved surface which travels only in one direction among the axial directions of the imaginary circular column when traveling in one direction among the circumferential directions of the imaginary circular column on the curved surface. That is, the spiral blade surface is a curved surface corresponding to a spiral which is a curve.

In this embodiment, a "spiral" is a consecutive space curve on a side surface of an imaginary circular column, and a space curve that advances in one direction among axial line directions of the imaginary circular column while advancing in one direction among circumferential directions of the imaginary circular column. In the case of being viewed on the one direction among the axial line directions of the imaginary circular column, the spiral advancing in a right-handed direction among circumferential directions of the imaginary circular column while advancing in the one direction among the axial line directions of the imaginary circular column is referred to as being a right-handed spiral, whereas a spiral advancing in the left-handed direction while advancing in the one direction among the axial line directions of the imaginary circular column is referred to as being a left-handed spiral. Further, a spiral which is wound around the side surface of the imaginary circular column by Z cycles in the circumferential direction (Z is an actual number which is larger than 0) is referred to as a Z-cyclic spiral.

Further, among the spirals, a spiral whose lead angle is constant in all points on the spiral is especially referred to as a "general spiral". Here, an angle formed of a tangent line of the spiral at a certain point on the spiral and a straight line that is made by projecting the tangent line to a vertical plane with respect to the axial line direction of the imaginary circular column surrounded by the spiral is a "lead angle" at the point. The lead angle is an angle that is larger than 0° and smaller than 90°.

In this embodiment, the inner spiral blade piece 202*a* is a general spiral blade piece which is a kind of a general spiral blade. In this embodiment, "general spiral blade" refers to a member having a predetermined thickness which has a general spiral blade surface as a main surface. The "general spiral blade surface" is a surface formed of the trajectory of one line segment $J_1$ outside an imaginary circular column $K_1$ (hereinafter a radius is $r_1$) when the line segment $J_1$ is moved in one direction $D_1$ parallel to the axial line of the imaginary circular column $K_1$ while maintaining a length $m_1$ of the line segment $J_1$ in a radial direction of the imaginary circular column $K_1$ and an attachment angle $\alpha$ of the line segment $J_1$ along one general spiral $C_1$ (hereinafter, a lead angle is constant at $\theta_1$) on a side surface of the imaginary circular column $K_1$. Here, the "attachment angle $\alpha$" is an angle formed by the line segment $J_1$ and a half-line extending along the one direction $D_1$ from a tangent point of the line segment $J_1$ and the imaginary circular column $K_1$ on a plane including the axial line of the imaginary circular column $K_1$ and the line segment $J_1$, and is an angle that is larger than 0° and smaller than 180°.

Figure 11A:
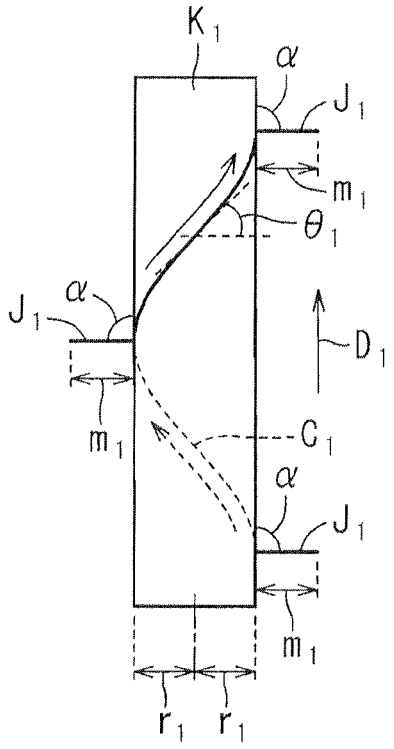
FIGS. 11A and 11B are views illustrating one cyclic general spiral blade surface.
Figure 11B:
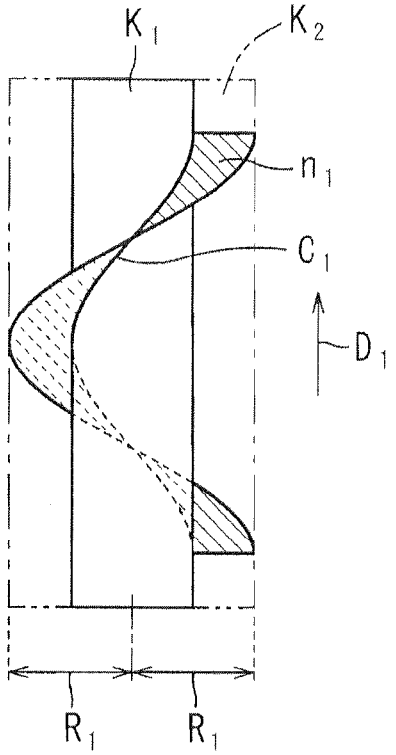

Hereinafter, as an example of the general spiral blade surface, a general spiral blade obtained when a line segment is moved along one cyclic portion of a general spiral (hereinafter, referred to as "one cyclic general spiral blade surface") is illustrated. FIGS. 11A and 11B are views illustrating one cyclic general spiral blade surface. FIG. 11A shows the side surface of the imaginary circular column $K_1$, the right-handed general spiral $C_1$ on the side surface of the imaginary circular column $K_1$, and the starting and ending positions of the line segment $J_1$ moving in one direction $D_1$ on the general spiral $C_1$. The line segment $J_1$ shown on the lowermost side of the sheet surface of FIG. 11A is the starting position of the moving line segment $J_1$, and the line segment $J_1$ shown on the uppermost side is the ending position. As shown in FIG. 11A, the trajectory of the line segment $J_1$ when the line segment $J_1$ is moved in one direction $D_1$ along the general spiral $C_1$ while constantly maintaining the length $m_1$ in the radial direction of the imaginary circular column $K_1$ and the attachment angle $\alpha$ ($\alpha$=90° in FIG. 11A) of the line segment $J_1$ corresponds to a general spiral blade surface $n_1$ shown in FIG. 11B. The surface depicted by a hatched portion in FIG. 11B is the general spiral blade surface $n_1$.

As shown in FIG. 11B, an outer circumferential portion of the general spiral blade surface $n_1$ becomes a right-handed general spiral that advances in the one direction $D_1$ on a side surface of an imaginary circular column $K_2$ whose axial line is identical with that of the imaginary circular column $K_1$. Here, the outer circumferential portion of the general spiral blade surface $n_1$ is a portion which is the most distant from the axial line of the imaginary circular column $K_1$ on the general spiral blade surface $n_1$. A radius $R_1$ of the imaginary circular column $K_2$ is equal to the sum of a radius $r_1$ of the imaginary circular column $K_1$ and the length $m_1$ of the line segment $J_1$ in the radial direction of the imaginary circular column $K_1$.

The member having the above-mentioned general spiral blade surface as the main surface is the general spiral blade, and particularly, the general spiral blade having the general spiral blade surface corresponding to one cycle or less as the main surface is referred to as the "general spiral blade piece" in this embodiment. In a case where the plurality of inner spiral blade pieces 202*a* is used as in this embodiment, the plurality of general spiral blade pieces is disposed so as to be spaced from each other so that a general spiral blade surface $n_1$ is disposed on the downstream side in the conveying direction X, and the developer is conveyed downstream in the conveying direction X by each general spiral blade surface $n_1$, respectively. Here, in this embodiment, the rotation direction $G_1$ is the left-handed direction when viewed in the conveying direction X. Therefore, in order to convey the developer downstream in the conveying direction X by the general spiral blade surface $n_1$, the general spiral blade pieces need to be implemented as a member having, as its main surface, a general spiral blade surface defined by a line segment which has been drawn along a right-handed general spiral, namely, a right-handed general spiral blade.

Further, in a case where the general spiral blade piece is used as the inner spiral blade piece 202*a*, an internal diameter $L_{13}$ of the inner spiral blade piece 202*a* (general spiral blade piece) becomes a value of two times the radius $r_1$ of the imaginary circular column $K_1$ shown in FIG. 11A, and an external diameter $L_{14}$ thereof becomes a value of two times the radius $R_1$ of the imaginary circular column $K_2$ shown in FIG. 11B. Here, the internal diameter $L_{13}$ of the inner spiral blade piece 202*a* (general spiral blade piece) is a value of two times the distance between an inner circumferential portion of the inner spiral blade piece 202*a* (general spiral blade piece) and the axial line of the imaginary circular column $K_1$. The inner circumferential portion is a part on the inner spiral blade piece 202*a* (general spiral blade piece) in which the distance from the axial line of the imaginary circular column $K_1$ is the closest thereto in a cross section perpendicular to the axial line of the imaginary circular column $K_1$. Further, the external diameter $L_{14}$ of the inner spiral blade piece 202*a* (general spiral blade piece) is a value of two times the distance between the outer circumferential portion of the inner spiral blade piece 202*a* (general spiral blade piece) and the axial line of the imaginary circular column $K_1$. The outer circumferential portion is a part on the inner spiral blade piece 202*a* (general spiral blade piece) in which the distance from the axial line of the imaginary circular column $K_1$ is the most distant therefrom in the cross section perpendicular to the axial line of the imaginary circular column $K_1$.

The internal diameter $L_{13}$ of the inner spiral blade piece 202*a* is settable as appropriate within a range of 0 mm or more and 5 mm or less, for example, and the external diameter $L_{14}$ is settable as appropriate within a range of 20 mm or more and 30 mm or less, for example. Further, for example, the attachment angle α may not be 90°, and is settable as appropriate within a range of 30° or more and 150° or less. The lead angle $\theta_1$ is settable as appropriate within the range of 20° or more and 70° or less, for example. Further, a thickness $L_{15}$ of the inner spiral blade piece 202*a* is settable as appropriate within a range of 1 mm or more and 3 mm or less. The length $L_{16}$ in a range where the plurality of inner spiral blade pieces 202*a* is disposed in the rotation tube 202*b* is settable as appropriate within a range of 150 mm or more and 300 mm or less.

In this embodiment, all the plurality of inner spiral blade pieces 202*a* have the same shape. For example, the respective inner spiral blade pieces 202*a* are ¼-cyclic general spiral blade pieces. Further, in this embodiment, the respective inner spiral blade pieces 202*a* are disposed at regular intervals.

Figure 12A:
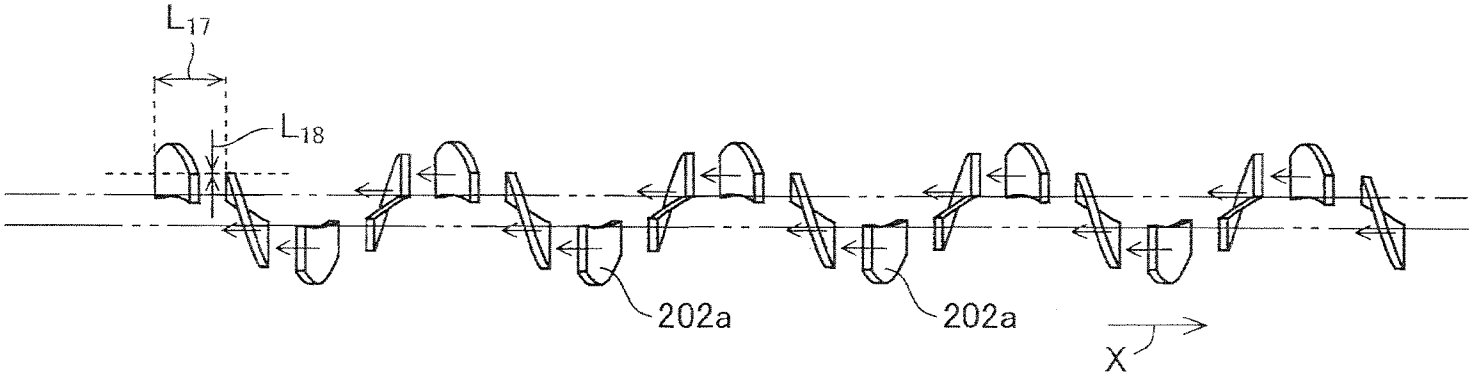
FIGS. 12A and 12B are diagrams illustrating arrangement of the respective inner spiral blade pieces according to an embodiment.
Figure 12B:
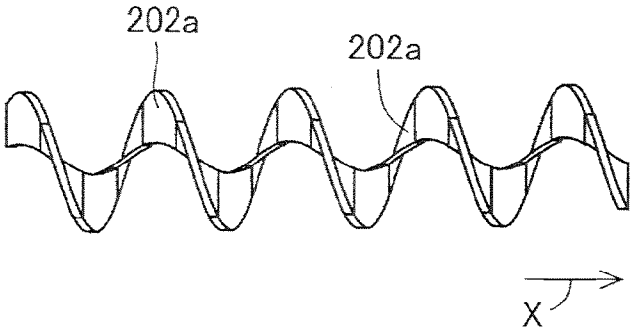

The arrangement of the respective inner spiral blade pieces 202*a* according to the embodiment using FIGS. 12A and 12B will be described. As shown in FIG. 12A, the respective inner spiral blade pieces 202*a* are disposed so as to be spaced from each other at regular intervals. For example, each of an interval $L_{17}$ of the respective inner spiral blade pieces 202*a* in the axial direction (conveying direction X) of the imaginary circular column which is wound by the plurality of inner spiral blade pieces 202*a* become the same in the range of 5 mm to 20 mm, and each of an interval $L_{18}$ of the respective inner spiral blade pieces 202*a* in the circumferential direction of the imaginary circular column become 0 mm. More specifically, the interval $L_{17}$ is a distance in the conveying direction X between the upstream end of one inner spiral blade piece 202*a* in the conveying direction X and the upstream end of the other inner spiral blade piece 202*a* in the conveying direction X which is adjacent on the downstream side in the conveying direction X with reference to the one inner spiral blade piece 202*a*. More specifically, the interval $L_{18}$ is a distance in the circumferential direction of the imaginary circular column between the downstream end of one inner spiral blade piece 202*a* in the conveying direction X and the upstream end of the other inner spiral blade piece 202*a* in the conveying direction X which is adjacent on the downstream side in the conveying direction X with reference to the one inner spiral blade piece 202*a*. Here, when the upstream end of the other inner spiral blade piece 202*a* in the conveying direction X is on the downstream side in the conveying direction X with reference to the upstream end of the one inner spiral blade piece 202*a* in the conveying direction X, the other inner spiral blade piece 202*a* is on the downstream side in the conveying direction X.

As described above, as shown in FIG. 12A, the plurality of inner spiral blade pieces 202*a* have the same shape, and each interval $L_{18}$ is 0 mm. Accordingly, if the respective inner spiral blade pieces 202*a* are moved to be connected in a direction indicated by arrows in FIG. 12A, as shown in FIG. 12B, the plurality of inner spiral blade pieces 202*a* becomes a continuous general spiral blades corresponding to cycles which exceed one cycle as a whole.

Figure 13:
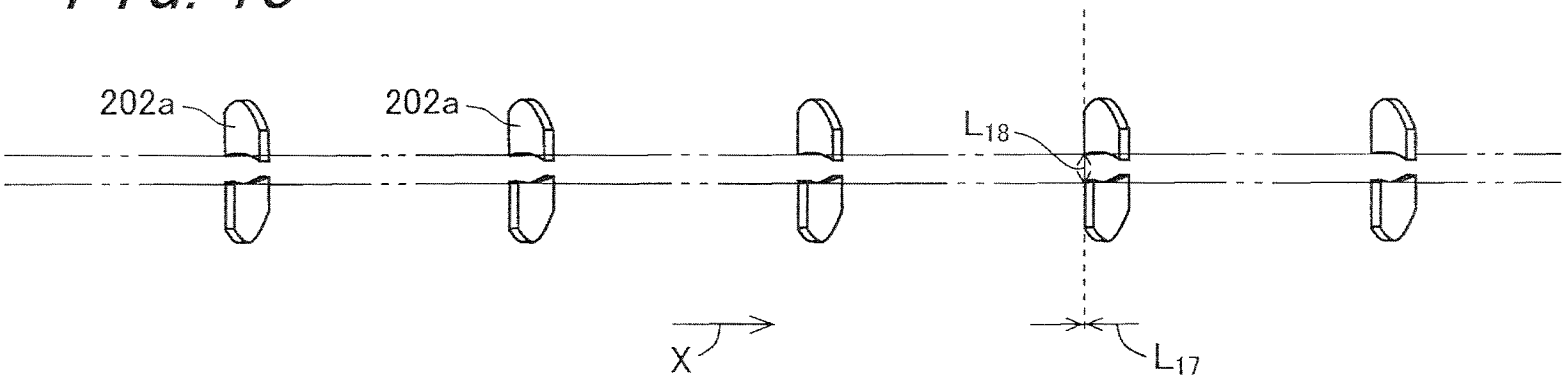
FIG. 13 is a diagram illustrating arrangement of the respective inner spiral blade pieces according to another embodiment.

As an another embodiment, the respective inner spiral blade pieces 202*a* may be arranged differently from the arrangement shown in FIG. 12A. FIG. 13 is a diagram illustrating arrangement of the respective inner spiral blade pieces 202*a* according to another embodiment. In this embodiment, the plurality of inner spiral blade pieces 202*a* have the same shape, and a pair of inner spiral blade pieces 202*a* is disposed at regular intervals in the conveying direction X. The pair of inner spiral blade pieces 202*a* includes one inner spiral blade piece 202*a* and the other inner spiral blade piece 202*a* which is adjacent on the downstream side with reference to the one inner spiral blade piece 202*a* in the conveying direction X. Here, the interval $L_{17}$ is 0 mm, and the interval $L_{18}$ is in a range of 2 mm to 7 mm.

Further, as still another embodiment which is different from the embodiment shown in FIG. 13, the respective inner spiral blade pieces 202*a* may not be the same shape, and the respective inner spiral blade pieces 202*a* may be disposed at a different interval which is larger than 0 mm in the axial direction and the circumferential direction of the imaginary circular column.

The rotation tube 202*b* is fixed to the outer circumferential portion of the plurality of inner spiral blade pieces 202*a* so as to surround the outer circumferential portion thereof. Accordingly, the rotation tube 202*b* rotates with the plurality of inner spiral blade pieces 202*a*.

Figure 14:
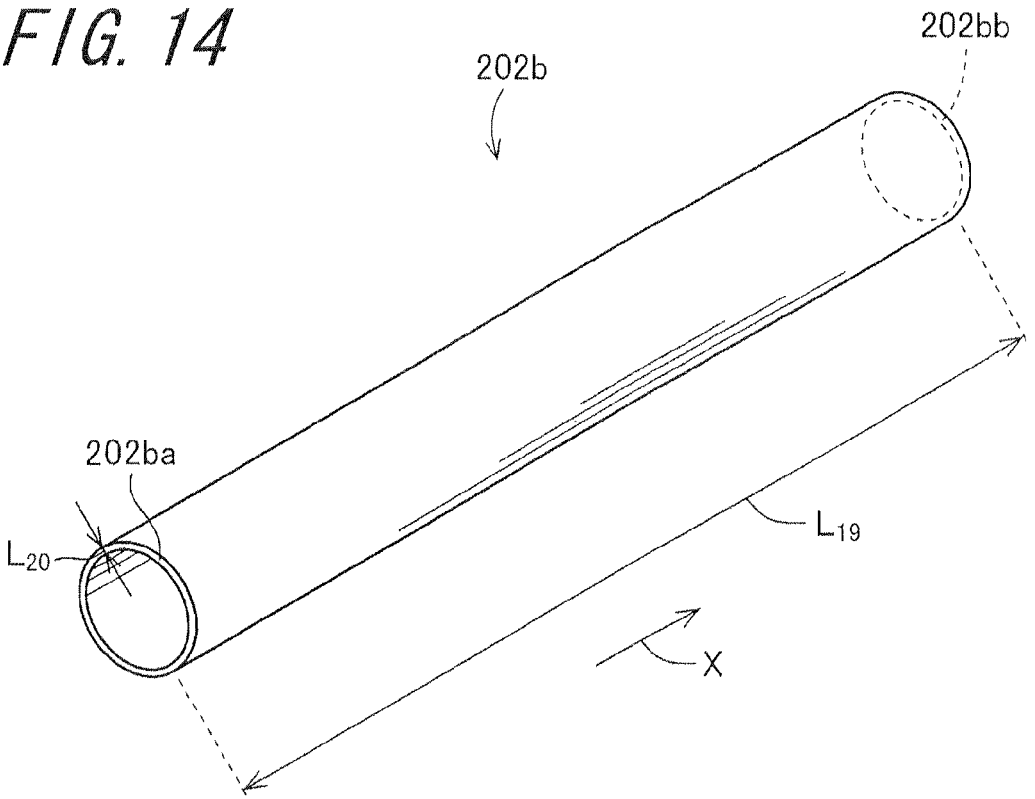
FIG. 14 is a perspective view illustrating the rotation tube.

FIG. 14 is a perspective view illustrating the rotation tube 202*b*. The rotation tube 202*b* is a hollow cylindrical member which extends along the conveying direction X. The axial line of the cylindrical rotation tube 202*b* coincides with the axial line of the imaginary circular column which is wound by the plurality of inner spiral blade pieces 202*a*. The length $L_{19}$ of the rotation tube 202*b* in the axial direction (conveying direction X) is settable as appropriate within a range of 280 mm or more and 320 mm or less, for example. The thickness $L_{20}$ of the rotation tube 202*b* is constant, and is settable as appropriate within a range of 1 mm or more and 3 mm or less, for example. The internal diameter of the rotation tube 202*b* is set to be the same as the external diameter $L_{14}$ of the inner spiral blade piece 202*a*.

The rotation tube 202*b* has an admission port portion 202*ba* in the upstream end in the conveying direction X. Further, the rotation tube 202*b* has a discharge port portion 202*bb* in the downstream end in the conveying direction X.

The admission port portion 202*ba* is formed on the upstream side bottom surface of the columnar rotation tube 202*b* in the conveying direction X. Further, an approximately circular hole which provides communication between an internal space of the rotation tube 202*b* and an external space thereof is formed in the admission port portion 202*ba*. The developer existing outside the rotation tube 202*b* in the developer tank 201 flows into the rotation tube 202*b* through the hole formed in the admission port portion 202*ba*. The admission port portion 202*ba* may be disposed on a side surface on the upstream side of the columnar rotation tube 202*b* in the conveying direction X, and two or more holes may be formed in the admission port portion 202*ba*.

The discharge port portion 202*bb* is formed on the downstream side bottom of the columnar rotation tube 202*b* in the conveying direction X. An approximately circular hole which provides communication between an internal space of the rotation tube 202*b* and an external space thereof is formed in the discharge port portion 202*bb*. The developer existing inside the rotation tube 202*b* flows outside the rotation tube 202*b* through the hole formed in the discharge port portion 202*bb*. The discharge port portion 202*bb* may be disposed on a side surface on the downstream side of the cylindrical rotation tube 202*b* in the conveying direction X, and two or more holes may be formed in the discharge port portion 202*bb*.

The upstream spiral blade 202*c* and the downstream spiral blade 202*d* are fixed to the rotation tube 202*b*. As shown in FIG. 10, a part of the upstream spiral blade 202*c* is fixed to the upstream end of the rotation tube 202*b* in the conveying direction X, on the upstream side in the conveying direction X with reference to the plurality of inner spiral blade pieces 202*a*. A part of the downstream spiral blade 202*d* is fixed to the downstream end of the rotation tube 202*b* in the conveying direction X, on the downstream side in the conveying direction X with reference to the plurality of inner spiral blade pieces 202*a*.

The upstream spiral blade 202*c* rotates with the inner spiral blade piece 202*a* and the rotation tube 202*b*, and guides the developer existing around the admission port portion 202*ba* outside the rotation tube 202*b* into the admission port portion 202*ba* by the rotation. The upstream spiral blade 202*c* has a shape which has a constant internal diameter and an external diameter which becomes small continuously as it advances on the upstream side in the conveying direction X. In other words, the upstream spiral blade 202*c* has a shape which has a constant internal diameter and the external diameter which becomes large continuously as it advances on the downstream side in the conveying direction X.

In the embodiment, the upstream spiral blade 202*c* is a continuous cone-shaped general spiral blade. In this embodiment, the "cone-shaped general spiral blade" is schematically a member in a shape in which an external diameter is continuously changed while maintaining an internal diameter constant in a general spiral blade. More specifically, the cone-shaped general spiral blade is a member with a predetermined thickness having a cone-shaped general spiral blade surface as described below as a main surface.

In this embodiment, the "cone-shaped general spiral blade surface" is a surface formed by the trajectory of one line segment $J_2$ outside an imaginary circular column $K_3$ (hereinafter, a radius is $r_2$) when the line segment $J_2$ is moved in one direction $D_2$ parallel to an axial line of the imaginary circular column $K_3$ while changing so that a length $m_2$ of the line segment $J_2$ in a radial direction of the imaginary circular column $K_3$ continuously becomes larger and maintaining an attachment angle β of the line segment $J_2$ along one general spiral $C_2$ (a lead angle is $\theta_2$) on a side surface of the imaginary circular column $K_3$. Here, the "attachment angle β" is an angle formed by the line segment $J_2$ and a half-line extending along the one direction $D_2$ from a tangent point of the line segment $J_2$ and the imaginary circular column $K_3$ on a plane including the axial line of the imaginary circular column $K_3$ and the line segment $J_2$, and is an angle that is larger than 0° and smaller than 180°.

Figure 15A:
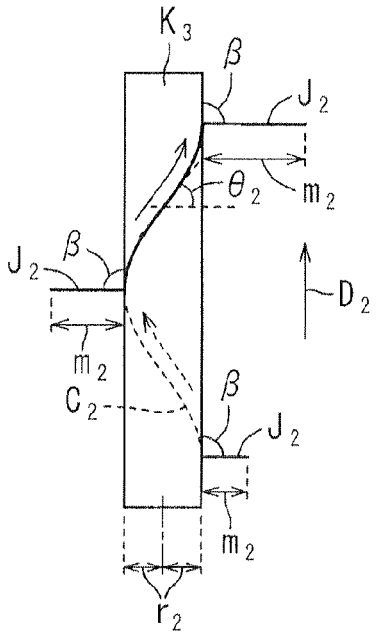
FIGS. 15A to 15D are views illustrating the one cyclic cone-shaped general spiral blade surface.

Hereinafter, as an example of the cone-shaped general spiral blade surface, a cone-shaped general spiral blade surface obtained when a line segment is moved along one cyclic portion of a general spiral (hereinafter, referred to as "one cyclic cone-shaped general spiral blade surface") is illustrated. FIGS. 15A to 15D are views illustrating the one cyclic cone-shaped general spiral blade surface. FIG. 15A shows a side surface of the imaginary circular column $K_3$, a right-handed general spiral $C_2$ on the side surface of the imaginary circular column $K_3$, and starting and end positions of the line segment $J_2$ moving in the one direction $D_2$ on the general spiral $C_2$. The line segment $J_2$ shown on the lowermost side of the sheet of FIG. 15A indicates the starting position in moving, and the line segment $J_2$ shown on the uppermost side indicates the end position. As shown in FIG. 15A, the trajectory of the line segment $J_2$ when the line segment $J_2$ is moved in the one direction $D_2$ along the general spiral $C_2$ while changing so that a length $m_2$ of the line segment $J_2$ in a radial direction of the imaginary circular column $K_3$ continuously becomes larger and constantly maintaining the attachment angle β (β=90° in FIG. 15A) of the line segment $J_2$ corresponds to a cone-shaped general spiral blade surface.

Figure 15B:
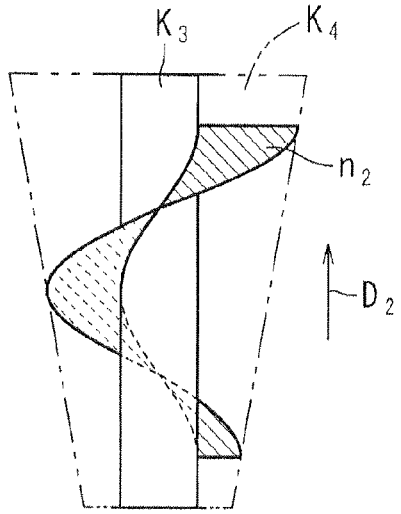
Figure 15C:
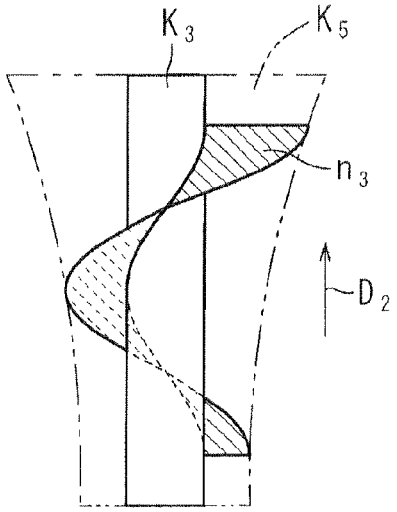
Figure 15D:
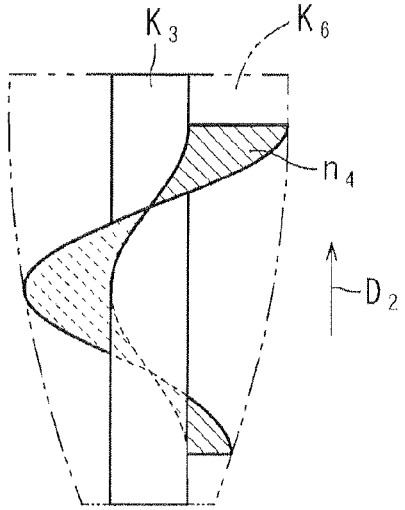

As shown in FIGS. 15B to 15D, an outer circumferential portion of the cone-shaped general spiral blade surface inscribes the side surface of an imaginary truncated cone having the same axial line as the imaginary circular column $K_3$. In this embodiment, the "truncated cone" as used herein is a solid having two bottom surfaces whose areas are different from each other, whose axial line runs through the two bottom surfaces, and whose external diameter continuously becomes larger as advancing in one direction of the axial line directions thereof. The shape of the imaginary truncated cone inscribed by the cone-shaped general spiral blade surface differs depending on the way that the length $m_2$ of the line segment $J_2$ changes. Further, in this embodiment, the outer circumferential portion of the cone-shaped general spiral blade surface is a portion which is the most distant from the axial line of the imaginary truncated cone on the general spiral blade surface.

FIG. 15B shows a cone-shaped general spiral blade surface $n_2$ inscribing an imaginary right circular truncated cone $K_4$. In this embodiment, the "right circular truncated cone" is a solid which is not a circular cone among two solids obtained by dividing a right circular cone on one plane parallel to the bottom surface. The trajectory of the line segment $J_2$ when the rate of change of the length $m_2$ of the line segment $J_2$ per unit moving distance along the general spiral $C_2$ is constant, corresponds to the cone-shaped general spiral blade surface $n_2$ depicted by the hatched portion in FIG. 15B, and the outer circumferential portion thereof inscribes the side surface of the imaginary right circular truncated cone $K_4$.

FIG. 15C shows a cone-shaped general spiral blade surface $n_3$ inscribing an imaginary compressed right circular truncated cone $K_5$. In this embodiment, the "compressed right circular truncated cone" is a solid having such a shape that the side surface of a right circular truncated cone is curved in a direction towards the axial line. The trajectory of the line segment $J_2$ when the rate of change of the length $m_2$ of the line segment $J_2$ per unit moving distance along the general spiral $C_2$ becomes gradually larger as advancing in one direction $D_2$, corresponds to the cone-shaped general spiral blade surface $n_3$ depicted by the hatched portion in FIG. 15C, and the outer circumferential portion thereof inscribes the side surface of the imaginary compressed right circular truncated cone $K_5$.

FIG. 15D shows a cone-shaped general spiral blade surface $n_4$ inscribing an imaginary expanded right circular truncated cone $K_6$. In this embodiment, the "expanded right circular truncated cone" is a solid having such a shape that the side surface of a right circular truncated cone is curved in a direction away from the axial line. The trajectory of the line segment $J_2$ when the rate of change of the length $m_2$ of the line segment $J_2$ per unit moving distance along the general spiral $C_2$ becomes gradually smaller as advancing in one direction $D_4$, corresponds to the cone-shaped general spiral blade surface $n_4$ depicted by the hatched portion in FIG. 15D, and the outer circumferential portion thereof inscribes the side surface of the imaginary expanded right circular truncated cone $K_6$.

The member with such a cone-shaped general spiral blade surface as the main surface is the cone-shaped general spiral blade. In a case where the cone-shaped general spiral blade is used as the upstream spiral blade 202*c* as in this embodiment, the cone-shaped general spiral blade is disposed so that the cone-shaped general spiral blade surfaces $n_2$, $n_3$ and $n_4$ are located on the downstream side in the conveying direction X. The developer is conveyed downstream in the conveying direction X by the cone-shaped general spiral blade surfaces $n_2$, $n_3$ and $n_4$. Here, the rotation direction $G_1$ is the left-handed direction when viewed in the conveying direction X. Therefore, in order to convey the developer downstream in the conveying direction X by the cone-shaped general spiral blade surfaces $n_2$, $n_3$ and $n_4$, the cone-shaped general spiral blade needs to be implemented as a member having, as its main surface, a cone-shaped general spiral blade surface defined by a line segment which has been drawn along a right-handed general spiraling line, namely, a right-handed cone-shaped general spiral blade.

Further, in a case where the cone-shaped general spiral blade is used as the upstream spiral blade 202*c*, an internal diameter $L_{21}$ of the upstream spiral blade 202*c* (cone-shaped general spiral blade) becomes a value of two times the radius $r_2$ of the imaginary circular column $K_3$ as shown in FIG. 15A, and an external diameter $L_{22}$ thereof is continuously changed from minimum value of $2m_2+2r_2$ to maximum value of $2m_2+2r_2$ as it advances on the downstream side in the conveying direction X, as shown in FIGS. 15B to 15D. Here, the internal diameter $L_{21}$ of the upstream spiral blade 202*c* (cone-shaped general spiral blade) is a value of two times a distance between an inner circumferential portion of the upstream spiral blade 202*c* (cone-shaped general spiral blade) and an axial line of the imaginary circular column $K_3$, and the inner circumferential portion is a part on the upstream spiral blade 202*c* (cone-shaped general spiral blade) in which the distance from the axial line of the imaginary circular column $K_3$ is the closest thereto in a cross section perpendicular to the axial line of the imaginary circular column $K_3$. Further, the external diameter $L_{22}$ of the upstream spiral blade 202*c* (cone-shaped general spiral blade) is a value of two times a distance between an outer circumferential portion of the upstream spiral blade 202*c* (cone-shaped general spiral blade) and the axial line of the imaginary circular column $K_3$, and the outer circumferential portion is a part on the upstream spiral blade 202*c* (cone-shaped general spiral blade) in which the distance from the axial line of the imaginary circular column $K_3$ is the most distant therefrom in the cross section perpendicular to the axial line of the imaginary circular column $K_3$.

The internal diameter $L_{21}$ of the upstream spiral blade 202*c* is settable as appropriate within a range of 5 mm or more and 15 mm or less, for example. The minimum value of the external diameter $L_{22}$ of the upstream spiral blade 202*c* is settable as appropriate within a range of 6 mm or more and 18 mm or less, for example, and the maximum value thereof is settable as appropriate within a range of 20 mm or more and 40 mm or less, for example. Further, for example, the attachment angle β may not be 90°, and is settable as appropriate within a range of 30° or more and 150° or less. The lead angle $\theta_2$ is settable as appropriate within a range of 20° or more and 70° or less, for example. Further, a thickness $L_{23}$ of the upstream spiral blade 202*c* is settable as appropriate within a range of 1 mm or more and 3 mm or less, a length $L_{24}$ of the upstream spiral blade 202*c* in the longitudinal direction thereof is settable as appropriate within a range of 20 mm or more and 50 mm or less, and a length $L_{25}$ of the upstream spiral blade 202*c* in the longitudinal direction thereof which is inside the rotation tube 202*c* tube is settable as appropriate within a range of 10 mm or more and 30 mm or less.

In this embodiment, the maximum value of the external diameter $L_{22}$ of the upstream spiral blade 202*c* is set to be the same as the external diameter $L_{14}$ of the inner spiral blade piece 202*a*, and the outer circumferential portion of the upstream spiral blade 202*c* is fixed to the inner peripheral wall of the rotation tube 202*b* in the position where the external diameter $L_{22}$ becomes the maximum. Further, the internal diameter $L_{21}$ of the upstream spiral blade 202*c* is set to be the same as the external diameter of the support member 202*e*, and the support member 202*e* on the upstream side in the conveying direction X is fixed to the inner circumferential portion of the upstream side spiral blade 202*c*.

The downstream spiral blade 202*d* rotates with the inner spiral blade piece 202*a* and the rotation tube 202*b*, and guides the developer existing around the discharge port portion 202*bb* outside the rotation tube 202*b* into the first communication path R by the rotation. The downstream side spiral blade 202*d* has a shape which has a constant internal diameter and an external diameter which becomes small continuously as it advances on the upstream side in the conveying direction X. In other words, the downstream spiral blade 202*d* has a shape which has a constant internal diameter and an external diameter which becomes large continuously as it advances on the downstream side in the conveying direction X.

In this embodiment, the downstream spiral blade 202*d* is a continuous right-handed cone-shaped general spiral blade, and is disposed so that the cone-shaped general spiral blade surfaces $n_2$, $n_3$ and $n_4$ are located on the downstream side in the conveying direction X. An internal diameter $L_{26}$ of the downstream spiral blade 202*d* is settable as appropriate within a range of 7 mm or more and 12 mm or less, for example, and the minimum value of an external diameter $L_{27}$ thereof is settable as appropriate within a range of 15 mm or more and 20 mm or less, for example, and the maximum value thereof is settable as appropriate within a range of 20 mm or more and 35 mm or less, for example. Further, for example, the attachment angle β described using FIG. 15A is settable as appropriate within a range of 30° or more and 150° or less. The lead angle $\theta_2$ is settable as appropriate within a range of 20° or more and 70° or less, for example. Further, a thickness $L_{28}$ of the downstream spiral blade 202*d* is settable as appropriate within a range of 1 mm or more and 3 mm or less, a length $L_{29}$ of the downstream spiral blade 202*d* in the longitudinal direction thereof is settable as appropriate within a range of 10 mm or more and 30 mm or less, and a length $L_{30}$ of the downstream spiral blade 202*d* in the longitudinal direction thereof which is inside the rotation tube 202*b* is settable as appropriate within a range of 10 mm or more and 30 mm or less.

In this embodiment, the external diameter $L_{27}$ of the downstream spiral blade 202*d* may be set to be the same as the internal diameter of the rotation tube 202*b* on the downstream end of the rotation tube 202*b* in the conveying direction X, and the outer circumferential portion of the downstream spiral blade 202*d* is fixed to the inner peripheral wall of the rotation tube 202*b* on the downstream end of the rotation tube 202*b* in the conveying direction X. Further, the internal diameter $L_{26}$ of the downstream spiral blade 202*d* is set to be the same as the external diameter of the support member 202*e*, and the support member 202*e* on the downstream side in the conveying direction X is fixed to the inner circumferential portion of the downstream spiral blade 202*d*.

According to the developing device 200 which includes the first developer conveying section 202 having the above-described configuration, the developer existing inside the first conveying path P in the developer tank 201 flows into the rotation tube 202*b* through the admission port portion 202*ba* of the rotation tube 202*b*. Further, the developer is conveyed downstream in the conveying direction X by the plurality of inner spiral blade pieces 202*a* inside the rotation tube 202*b*, and flows outside the rotation tube 202*b* through the discharge port portion 202*bb* of the rotation tube 202*b*. At this time, the rotation tube 202*b* rotates with the plurality of inner spiral blade pieces 202*a*. Friction arises between the developer conveyed by the plurality of inner spiral blade pieces 202*a* and the inner peripheral wall of the rotation tube 202*b* by the rotational movement, to thereby charge the developer.

Accordingly, the developing device 200 according to this embodiment can suppress the developer from being compressed, and can sufficiently charge the developer to be conveyed in the first conveying path P. Further, the developing device 200 can rapidly and sufficiently charge even a new toner which has just been supplied to the developer tank 201 from the toner cartridge 300. Further, since the developer is conveyed by the plurality of inner spiral blade pieces which are disposed so as to be spaced from each other rather than a single continuous spiral blade, the developing device 200 can suppress, when a new toner is supplied to the developing device, the movement of the new toner from being obstructed by the plurality of inner spiral blade pieces, and can efficiently diffuse the new toner into the developer as the developer is conveyed. Thus, according to the image forming apparatus 100 which includes the developing device 200, it is possible to form a high quality image in which image density unevenness is suppressed.

In a case where the developer stored in the developer tank 201 is a two-component developer including a toner and a carrier, when the two-component developer is conveyed by the plurality of inner spiral blade pieces 202*a*, the two-component developer is mixed by the friction which arises between the two-component developer and the inner peripheral wall of the rotation tube 202*b*. Accordingly, according to the developing device 200, it is possible to sufficiently mix the toner with the carrier. Further, the developing device 200 can rapidly and sufficiently mix even a new toner which has just been supplied to the developer tank 201 from the toner cartridge 300 with a carrier, by the first developer conveying section 202.

Further, in this embodiment, the plurality of inner spiral blade pieces 202*a* have the same shape and are disposed so as to be spaced from each other at regular intervals. Thus, the movement speed of the developer conveyed by the plurality of inner spiral blade pieces 202*a* becomes uniform in the rotation tube, and thus, it is possible to suppress the developer from being compressed.

Further, in this embodiment, the first developer conveying section 202 includes the upstream spiral blade 202*c* which is disposed on the upstream side with reference to the plurality of inner spiral blade pieces 202*a* in the conveying direction X, and has the shape which has the constant internal diameter and the external diameter which becomes small continuously as it advances on the upstream side in the conveying direction X (that is, the shape having the external diameter which becomes large continuously as it advances on the downstream side in the conveying direction X). Thus, the amount of the developer conveyed downstream in the conveying direction X by the upstream spiral blade 202*c* gradually increases as it advances on the downstream side in the conveying direction X. Thus, it is possible to slow down the conveyance speed of the developer conveyed by the entire upstream spiral blade 202*c* while increasing the conveyance amount of the developer around the admission port portion 202*ba* of the rotation tube 202*b*. As a result, it is possible to reliably guide the developer to the inside of the rotation tube 202*b*.

Further, it is preferable that the upstream spiral blade 202*c* is the cone-shaped general spiral blade having the cone-shaped general spiral blade surface $n_3$ which inscribes the imaginary compressed right circular truncated cone $K_5$, as shown in FIG. 15C, in order to suppress the conveyance speed of the entire developer and to increase the conveyance amount of the developer around the admission port portion 202*ba*, as described above. Further, as another embodiment, the upstream spiral blade 202*c* may not be provided.

Further, in this embodiment, the rotation tube 202*b* is disposed to be inclined so that the portion on the downstream side thereof in the conveying direction X is disposed vertically above the portion on the upstream side thereof in the conveying direction X, and the first conveying path-downstream region bottom part 201*f* of the developer tank 201 is disposed vertically below the portion on the downstream side of the rotation tube 202*b* in the conveying direction X. Thus, the developer which is guided to the inside of the rotation tube 202*b* by the upstream spiral blade 202*c* and is conveyed by the plurality of inner spiral blade pieces 202*a* as described above drops onto the first conveying path-downstream region bottom part 201*f* when flowing out of the discharge port portion 202*bb*. As a result, it is possible to suppress the developer from being retained on the downstream side of the first conveying path P in the conveying direction X due to the impact of the drop, thereby making it possible to smoothly convey the developer.

Further, in this embodiment, the barrier part 201*g* is formed which is adjacent to the first conveying path-downstream region bottom part 201*f* on the upstream side in the conveying direction X with reference to the first conveying path-downstream region bottom part 201*f* and is protruded vertically above the first conveying path-downstream region bottom part 201*f*. Thus, the developing device 200 can suppress the developer from entering between the first developer conveying section 202 and the inner wall of the developer tank 201 from the downstream side in the conveying direction X. As another embodiment, the barrier part 201*g* may not be formed.

Further, in this embodiment, the first conveying path-upstream region bottom part 201*e* is formed to be inclined so that the portion on the upstream side thereof in the conveying direction X is disposed vertically above the portion on the downstream side thereof in the conveying direction X. Accordingly, the developer on the first conveying path-upstream region bottom part 201*e* moves downstream in the conveying direction X due to its own weight. Thus, the developing device 200 can smoothly convey the developer on the upstream side of the first conveying path P in the conveying direction X to the admission port portion 202*ba* of the rotation tube 202*b*, and as a result, can suppress stress generated in the developer. Further, since the upstream spiral blade 202*c* extends along the first conveying path-upstream region bottom part 201*e* as the first conveying path-upstream region bottom part 201*e* is inclined, it is possible to more smoothly convey the developer to the admission port portion 202*ba* of the rotation tube 202*b*.

Further, in this embodiment, the first developer conveying section 202 includes the support members 202*e* on the upstream side and the downstream side in the conveying direction X, respectively. Thus, it is possible to drive the first developer conveying section 202 through the support members 202*e*, thereby making it possible to simplify a drive mechanism of the developing device 200. As another embodiment, the first developer conveying section 202 may be supported without the support members 202*e*.

Further, in this embodiment, the first developer conveying section 202 includes the downstream spiral blade 202*d* which is disposed on the downstream side in the conveying direction X with reference to the plurality of inner spiral blade pieces 202*a*. Using the downstream spiral blade 202*d*, it is possible to suppress the developer from being retained around the discharge port portion 202*bb* of the rotation tube 202*b*, and to smoothly flow the developer around the first communication path R. As a result, it is possible to suppress stress generated in the developer. As another embodiment, a circumferential rotation plate may be fixed to the support member 202*e*, on the downstream side of the downstream spiral blade 202*d* in the conveying direction X.

Further, in this embodiment, nothing is provided inside the inner spiral blade pieces 202*a*, and the internal space thereof is used as a movement space of the developer. That is, since the developer existing inside the internal space of the inner spiral blade pieces 202*a* is not pressed by the inner spiral blade pieces 202*a*, the developer tends to stay at the position without moving downstream in the conveying direction X. As a result, the developer which stays in the internal space of the inner spiral blade pieces 202*a* appears to move upstream in the conveying direction X with reference to the developer which moves downstream in the conveying direction X. Accordingly, in this embodiment, the developer tends to relatively move in two directions inside the rotation tube 202*b*, which causes a repulsive action in the developer. Thus, a part of the developer easily moves in a direction other than the conveying direction X, for example, the vertical direction. Accordingly, friction easily arises between the developer and the inner spiral blade pieces 202*a* or the rotation tube 202*b*, to thereby reliably charge the developer. Further, since nothing is provided inside the inner spiral blade pieces 202*a*, it is possible to store more developer in the developer tank 201. As another embodiment, a cylindrical member may be fixed to an inner circumferential portion of the inner spiral blade piece 202*a*.

Further, in this embodiment, the first conveying path central bottom part 201*a* extends to be inclined so that the portion on the downstream side thereof in the conveying direction X is disposed vertically above the portion on the upstream side thereof in the conveying direction X. Accordingly, the developer on the first conveying path central bottom part 201*a* moves upstream in the conveying direction X due to its own weight. Thus, the developing device 200 can suppress the developer from being retained between the first developer conveying section 202 and the bottom part of the developer tank 201 at the intermediate position in the conveying direction X.

Further, the first communication path bottom part 201*c* is formed to be inclined so that the portion thereof on the side of the first conveying path P is disposed vertically above the portion thereof on the side of the second conveying path Q. Accordingly, the developer on the first communication path bottom part 201*c* moves to the side of the second conveying path Q due to its own weight. Thus, the developing device 200 can suppress the developer from being retained in the first communication path R. Further, the second communication path bottom part 201*d* is formed to be inclined so that the portion thereof on the side of the second conveying path Q is disposed vertically above the portion thereof on the side of the first conveying path P. Accordingly, the developer on the second communication path bottom part 201*d* moves to the side of the first conveying path P due to its own weight. Thus, the developing device 200 can suppress the developer from being retained in the second communication path S.

As described above, in this embodiment, since it is possible to suppress the developer from being retained in the first conveying path P, the first communication path R and the second communication path S, it is possible to smoothly convey the developer, and as a result, to suppress stress generated in the developer. As another embodiment, the first conveying path central bottom part 201*a*, the first communication path bottom part 201*c* and the second communication path bottom part 201*d* may be formed in the approximately horizontal direction.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device for developing an electrostatic latent image formed on an image bearing member by supplying a stored developer to the image bearing member, comprising:

a developer tank that stores a developer;

a partition wall that divides an internal space of the developer tank into a first conveying path extending along a longitudinal direction of the partition wall, a second conveying path located toward the image bearing member, which is opposed to the first conveying path, with the partition wall, a first communication path for providing communication between the first conveying path and the second conveying path at a side of one longitudinal end of the partition wall, and a second communication path for providing communication between the first conveying path and the second conveying path at a side of another longitudinal end of the partition wall;

a first developer conveying section that is disposed in the first conveying path and conveys a developer in the developer tank from the side of the another longitudinal end to the side of the one longitudinal end, the first developer conveying section including a plurality of individual inner spiral blade pieces which together have a spiral shape which is wound around a side surface of an imaginary circular column and conveys the developer toward the side of the one longitudinal end from the side of the another longitudinal end by rotation around an axial line of the imaginary circular column, the plurality of inner spiral blade pieces being disposed so as to be spaced from each other in an extending direction of the spiral shape, and a rotation tube which surrounds an outer circumferential portion of the plurality of inner spiral blade pieces, and rotates with the plurality of inner spiral blade pieces, the rotation tube having an admission port portion which is formed with a hole for admitting the developer into the rotation tube and is disposed on the side of the another longitudinal end of the partition wall, and a discharge port portion which is formed with a hole for discharging the developer from an inside of the rotation tube and is disposed on the side of the one longitudinal end of the partition wall; and a second developer conveying section which is disposed in the second conveying path and conveys a developer in the developer tank from the side of the one longitudinal end to the side of the another longitudinal end.

2. The developing device of claim 1, wherein the plurality of inner spiral blade pieces have a same shape and are disposed so as to be spaced from each other at regular intervals.

3. The developing device of claim 1, wherein the first developer conveying section includes an upstream spiral blade which guides the developer existing outside the rotation tube to the admission port portion, is disposed on the side of the another longitudinal end with reference to the plurality of inner spiral blade pieces, and has a shape which has a constant internal diameter and an external diameter which becomes small continuously as it advances on the side of the another longitudinal end, the rotation tube is disposed to be inclined so that the side of the one end in the longitudinal direction thereof is disposed vertically above the side of the another end in the longitudinal direction thereof, and the developer tank includes a first conveying path-downstream region bottom part which faces a portion on the side of the one end in the longitudinal direction of the first conveying path and is disposed vertically below the portion on the side of the one end in the longitudinal direction of the rotation tube.

4. The developing device of claim 3, wherein the developer tank includes a barrier part which is adjacent to the first conveying path-downstream region bottom part on the side of the another longitudinal end with reference to the first conveying path-downstream region bottom part and is protruded vertically above the first conveying path-downstream region bottom part.

5. An electrophotographic image forming apparatus comprising the developing device of claim 1.

* * * * *